US012416308B2

(12) United States Patent
Striebich et al.

(10) Patent No.: US 12,416,308 B2
(45) Date of Patent: Sep. 16, 2025

(54) COMPRESSOR WITH SHUTDOWN ASSEMBLY

(71) Applicant: Copeland LP, Sidney, OH (US)

(72) Inventors: Daniel J. Striebich, Troy, OH (US); Lukas Gephart, Sidney, OH (US); Saurabh Prabhakar, Pune (IN); Yogesh S. Mahure, Pune (IN); Joseph M. Shepherd, Lima, OH (US)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 18/394,474

(22) Filed: Dec. 22, 2023

(65) Prior Publication Data

US 2024/0218881 A1 Jul. 4, 2024

(30) Foreign Application Priority Data

Dec. 28, 2022 (IN) ..... 202221076341

(51) Int. Cl.
*F04C 18/02* (2006.01)
*F04C 27/00* (2006.01)
(Continued)

(52) U.S. Cl.
CPC ..... *F04C 29/12* (2013.01); *F04C 18/0215* (2013.01); *F04C 18/0261* (2013.01); *F04C 27/005* (2013.01); *F04C 28/26* (2013.01)

(58) Field of Classification Search
CPC .. F04C 29/12; F04C 18/0215; F04C 18/0261; F04C 27/005; F04C 28/26
See application file for complete search history.

(56) References Cited

U.S. PATENT DOCUMENTS 3,303,988 A 2/1967 Weatherhead
3,777,508 A 12/1973 Imabayashi et al.
(Continued)

FOREIGN PATENT DOCUMENTS

AU 2002301023 B2 6/2005
CN 1137614 A 12/1996
(Continued)

OTHER PUBLICATIONS

Notice of Allowance regarding U.S. Appl. No. 15/692,844, dated Feb. 20, 2020.
(Continued)

*Primary Examiner* — Deming Wan
(74) *Attorney, Agent, or Firm* — Harness, Dickey & Pierce, P.L.C.

(57) ABSTRACT

A compressor may include first and second scrolls, and a shutdown assembly. The first and second scrolls have first and second spiral wraps, respectively. The second scroll includes a discharge passage that receives compressed working fluid from a pocket defined by the first and second spiral wraps. The shutdown assembly may include a valve housing and a valve member. The valve housing may include a first aperture that receives working fluid from the discharge passage. The valve member may include a valve stem and a valve head. The valve stem may be movably received in a second aperture of the valve housing and has a smaller diameter than a diameter of the valve head. The valve member may be movable between a closed position in which the valve head restricts flow through the discharge passage and an open position in which the valve head allows flow through the discharge passage.

11 Claims, 8 Drawing Sheets

(51) Int. Cl.
*F04C 28/26* (2006.01)
*F04C 29/12* (2006.01)

(56) References Cited

U.S. PATENT DOCUMENTS 4,058,988 A 11/1977 Shaw
4,197,719 A 4/1980 Shaw
4,216,661 A 8/1980 Tojo et al.
4,313,314 A 2/1982 Boyanich
4,382,370 A 5/1983 Suefuji et al.
4,383,805 A 5/1983 Teegarden et al.
4,389,171 A 6/1983 Eber et al.
4,466,784 A 8/1984 Hiraga
4,469,126 A 9/1984 Simpson
4,475,360 A 10/1984 Suefuji et al.
4,475,875 A 10/1984 Sugimoto et al.
4,480,965 A 11/1984 Ishizuka
4,496,296 A 1/1985 Arai et al.
4,497,615 A 2/1985 Griffith
4,508,491 A 4/1985 Schaefer
4,545,742 A 10/1985 Schaefer
4,547,138 A 10/1985 Mabe et al.
4,552,518 A 11/1985 Utter
4,564,339 A 1/1986 Nakamura et al.
4,580,949 A 4/1986 Maruyama et al.
4,609,329 A 9/1986 Pillis et al.
4,650,405 A 3/1987 Iwanami et al.
4,696,630 A 9/1987 Sakata et al.
4,727,725 A 3/1988 Nagata et al.
4,772,188 A 9/1988 Kimura et al.
4,774,816 A 10/1988 Uchikawa et al.
4,818,195 A 4/1989 Murayama et al.
4,824,344 A 4/1989 Kimura et al.
4,838,773 A 6/1989 Noboru
4,842,499 A 6/1989 Nishida et al.
4,846,633 A 7/1989 Suzuki et al.
4,877,382 A 10/1989 Caillat et al.
4,886,425 A 12/1989 Itahana et al.
4,886,433 A 12/1989 Maier
4,898,520 A 2/1990 Nieter et al.
4,927,339 A 5/1990 Riffe et al.
4,936,543 A 6/1990 Kamibayasi
4,940,395 A 7/1990 Yamamoto et al.
4,954,057 A 9/1990 Caillat et al.
4,990,071 A 2/1991 Sugimoto
4,997,349 A 3/1991 Richardson, Jr.
5,024,589 A 6/1991 Jetzer et al.
5,040,952 A 8/1991 Inoue et al.
5,040,958 A 8/1991 Arata et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
5,098,265 A 3/1992 Machida et al.
5,145,346 A 9/1992 Iio et al.
5,152,682 A 10/1992 Morozumi et al.
RE34,148 E 12/1992 Terauchi et al.
5,169,294 A 12/1992 Barito
5,171,141 A 12/1992 Morozumi et al.
5,192,195 A 3/1993 Iio et al.
5,193,987 A 3/1993 Iio et al.
5,199,862 A 4/1993 Kondo et al.
5,213,489 A 5/1993 Kawahara et al.
5,240,389 A 8/1993 Oikawa et al.
5,253,489 A 10/1993 Yoshii
5,304,047 A 4/1994 Shibamoto
5,318,424 A 6/1994 Bush et al.
5,330,463 A 7/1994 Hirano
5,336,068 A 8/1994 Sekiya et al.
5,340,287 A 8/1994 Kawahara et al.
5,355,688 A 10/1994 Rafalovich et al.
5,356,271 A 10/1994 Miura et al.
5,385,034 A 1/1995 Haselden
5,395,224 A 3/1995 Caillat et al.
5,411,384 A 5/1995 Bass et al.
5,425,626 A 6/1995 Tojo et al.
5,427,512 A 6/1995 Kohsokabe et al.
5,451,146 A 9/1995 Inagaki et al.
5,458,471 A 10/1995 Ni
5,458,472 A 10/1995 Kobayashi et al.
5,482,637 A 1/1996 Rao et al.
5,497,629 A 3/1996 Rafalovich et al.
5,511,959 A 4/1996 Tojo et al.
5,547,354 A 8/1996 Shimizu et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,591,014 A 1/1997 Wallis et al.
5,607,288 A 3/1997 Wallis et al.
5,611,674 A 3/1997 Bass et al.
5,613,841 A 3/1997 Bass et al.
5,622,487 A 4/1997 Fukuhara et al.
5,624,247 A 4/1997 Nakamura
5,639,225 A 6/1997 Matsuda et al.
5,640,854 A 6/1997 Fogt et al.
5,649,817 A 7/1997 Yamazaki
5,660,539 A 8/1997 Matsunaga et al.
5,667,371 A 9/1997 Prenger et al.
5,674,058 A 10/1997 Matsuda et al.
5,678,626 A 10/1997 Gilles
5,678,985 A 10/1997 Brooke et al.
5,680,898 A 10/1997 Rafalovich et al.
5,707,210 A 1/1998 Ramsey et al.
5,722,257 A 3/1998 Ishii et al.
5,741,120 A 4/1998 Bass et al.
5,755,104 A 5/1998 Rafalovich et al.
5,775,893 A 7/1998 Takao et al.
5,791,328 A 8/1998 Alexander
5,842,843 A 12/1998 Haga
5,855,475 A 1/1999 Fujio et al.
5,885,063 A 3/1999 Makino et al.
5,888,057 A 3/1999 Kitano et al.
5,938,417 A 8/1999 Takao et al.
5,993,171 A 11/1999 Higashiyama
5,993,177 A 11/1999 Terauchi et al.
6,010,312 A 1/2000 Suitou et al.
6,015,277 A 1/2000 Richardson, Jr.
6,030,192 A 2/2000 Hill et al.
6,047,557 A 4/2000 Pham et al.
6,056,523 A 5/2000 Won et al.
6,065,948 A 5/2000 Brown
6,068,459 A 5/2000 Clarke et al.
6,086,335 A 7/2000 Bass et al.
6,093,005 A 7/2000 Nakamura
6,095,764 A 8/2000 Shibamoto et al.
6,095,765 A 8/2000 Khalifa
6,102,671 A 8/2000 Yamamoto et al.
6,120,255 A 9/2000 Schumann et al.
6,123,517 A 9/2000 Brooke et al.
6,123,528 A 9/2000 Sun et al.
6,132,179 A 10/2000 Higashiyama
6,132,191 A 10/2000 Hugenroth et al.
6,139,287 A 10/2000 Kuroiwa et al.
6,139,291 A 10/2000 Perevozchikov
6,149,401 A 11/2000 Iwanami et al.
6,152,714 A 11/2000 Mitsuya et al.
6,164,940 A 12/2000 Terauchi et al.
6,174,149 B1 1/2001 Bush
6,176,686 B1 1/2001 Wallis et al.
6,179,589 B1 1/2001 Bass et al.
6,182,646 B1 2/2001 Silberstein et al.
6,202,438 B1 3/2001 Barito
6,210,120 B1 4/2001 Hugenroth et al.
6,213,731 B1 4/2001 Doepker et al.
6,217,302 B1 4/2001 Sun et al.
6,224,356 B1 5/2001 Dewar et al.
6,227,830 B1 5/2001 Fields et al.
6,231,316 B1 5/2001 Wakisaka et al.
6,257,840 B1 7/2001 Ignatiev et al.
6,264,444 B1 7/2001 Nakane et al.
6,264,452 B1 7/2001 Sun et al.

(56) References Cited

U.S. PATENT DOCUMENTS 6,267,565 B1 7/2001 Seibel et al.
6,273,691 B1 8/2001 Morimoto et al.
6,280,154 B1 8/2001 Clendenin et al.
6,290,477 B1 9/2001 Gigon
6,293,767 B1 9/2001 Bass
6,293,776 B1 9/2001 Hahn et al.
6,309,194 B1 10/2001 Fraser et al.
6,322,340 B1 11/2001 Itoh et al.
6,327,871 B1 12/2001 Rafalovich
6,338,912 B1 1/2002 Ban et al.
6,350,111 B1 2/2002 Perevozchikov et al.
6,361,890 B1 3/2002 Ban et al.
6,379,123 B1 4/2002 Makino et al.
6,379,133 B1 4/2002 Hahn et al.
6,389,837 B1 5/2002 Morozumi
6,412,293 B1 7/2002 Pham et al.
6,413,058 B1 7/2002 Williams et al.
6,419,457 B1 7/2002 Seibel et al.
6,422,842 B2 7/2002 Sheridan et al.
6,428,286 B1 8/2002 Shimizu et al.
6,454,551 B2 9/2002 Kuroki et al.
6,457,948 B1 10/2002 Pham
6,457,952 B1 10/2002 Haller et al.
6,464,481 B2 10/2002 Tsubai et al.
6,478,550 B2 11/2002 Matsuba et al.
6,506,036 B2 1/2003 Tsubai et al.
6,514,060 B1 2/2003 Ishiguro et al.
6,537,043 B1 3/2003 Chen
6,544,016 B2 4/2003 Gennami et al.
6,558,143 B2 5/2003 Nakajima et al.
6,589,035 B1 7/2003 Tsubono et al.
6,619,062 B1 9/2003 Shibamoto et al.
6,672,845 B1 1/2004 Kim et al.
6,679,683 B2 1/2004 Seibel et al.
6,705,848 B2 3/2004 Scancarello
6,715,999 B2 4/2004 Ancel et al.
6,746,223 B2 6/2004 Manole
6,749,412 B2 6/2004 Narasipura et al.
6,769,881 B2 8/2004 Lee
6,769,888 B2 8/2004 Tsubono et al.
6,773,242 B1 8/2004 Perevozchikov
6,817,847 B2 11/2004 Agner
6,821,092 B1 11/2004 Gehret et al.
6,863,510 B2 3/2005 Cho
6,881,046 B2 4/2005 Shibamoto et al.
6,884,042 B2 4/2005 Zili et al.
6,887,051 B2 5/2005 Sakuda et al.
6,893,229 B2 5/2005 Choi et al.
6,896,493 B2 5/2005 Chang et al.
6,896,498 B1 5/2005 Patel
6,913,448 B2 7/2005 Liang et al.
6,984,114 B2 1/2006 Zili et al.
7,018,180 B2 3/2006 Koo
7,029,251 B2 4/2006 Chang et al.
7,112,046 B2 9/2006 Kammhoff et al.
7,118,358 B2 10/2006 Tsubono et al.
7,137,796 B2 11/2006 Tsubono et al.
7,160,088 B2 1/2007 Peyton
7,172,395 B2 2/2007 Shibamoto et al.
7,197,890 B2 4/2007 Taras et al.
7,207,787 B2 4/2007 Liang et al.
7,228,710 B2 6/2007 Lifson
7,229,261 B2 6/2007 Morimoto et al.
7,255,542 B2 8/2007 Lifson et al.
7,261,527 B2 8/2007 Alexander et al.
7,311,740 B2 12/2007 Williams et al.
7,344,365 B2 3/2008 Takeuchi et al.
RE40,257 E 4/2008 Doepker et al.
7,354,259 B2 4/2008 Tsubono et al.
7,364,416 B2 4/2008 Liang et al.
7,371,057 B2 5/2008 Shin et al.
7,371,059 B2 5/2008 Ignatiev et al.
RE40,399 E 6/2008 Hugenroth et al.
RE40,400 E 6/2008 Bass et al.
7,393,190 B2 7/2008 Lee et al.
7,404,706 B2 7/2008 Ishikawa et al.
7,421,846 B2 9/2008 Narayanamurthy et al.
7,429,167 B2 9/2008 Bonear et al.
RE40,554 E 10/2008 Bass et al.
7,484,374 B2 2/2009 Pham et al.
7,510,382 B2 3/2009 Jeong
7,547,202 B2 6/2009 Knapke
7,641,455 B2 1/2010 Fujiwara et al.
7,674,098 B2 3/2010 Lifson
7,695,257 B2 4/2010 Joo et al.
7,717,687 B2 5/2010 Reinhart
7,771,178 B2 8/2010 Perevozchikov et al.
7,802,972 B2 9/2010 Shimizu et al.
7,815,423 B2 10/2010 Guo et al.
7,827,809 B2 11/2010 Pham et al.
7,891,961 B2 2/2011 Shimizu et al.
7,896,629 B2 3/2011 Ignatiev et al.
RE42,371 E 5/2011 Peyton
7,956,501 B2 6/2011 Jun et al.
7,967,582 B2 6/2011 Akei et al.
7,967,583 B2 6/2011 Stover et al.
7,972,125 B2 7/2011 Stover et al.
7,976,289 B2 7/2011 Masao
7,976,295 B2 7/2011 Stover et al.
7,988,433 B2 8/2011 Akei et al.
7,988,434 B2 8/2011 Stover et al.
8,020,402 B2 9/2011 Pham et al.
8,025,492 B2 9/2011 Seibel et al.
8,079,229 B2 12/2011 Lifson et al.
8,162,622 B2 * 4/2012 Shoulders ..... F04C 29/061 417/295
8,181,470 B2 5/2012 Narayanamurthy et al.
8,303,278 B2 11/2012 Roof et al.
8,303,279 B2 11/2012 Hahn
8,308,448 B2 11/2012 Fields et al.
8,313,318 B2 11/2012 Stover et al.
8,328,531 B2 12/2012 Milliff et al.
8,328,543 B2 12/2012 Wilson
8,393,882 B2 3/2013 Ignatiev et al.
8,424,326 B2 4/2013 Mitra et al.
8,505,331 B2 8/2013 Pham et al.
8,506,271 B2 8/2013 Seibel et al.
8,517,703 B2 8/2013 Doepker
8,585,382 B2 11/2013 Akei et al.
8,616,014 B2 12/2013 Stover et al.
8,672,646 B2 3/2014 Ishizono et al.
8,707,723 B2 4/2014 Narayanamurthy
8,757,988 B2 6/2014 Fukudome et al.
8,790,098 B2 7/2014 Stover et al.
8,840,384 B2 9/2014 Patel et al.
8,857,200 B2 10/2014 Stover et al.
8,932,036 B2 1/2015 Monnier et al.
9,068,765 B2 6/2015 Huff
9,080,446 B2 7/2015 Heusler et al.
9,127,677 B2 9/2015 Doepker
9,145,891 B2 9/2015 Kim et al.
9,169,839 B2 10/2015 Ishizono et al.
9,194,395 B2 11/2015 Ginies et al.
9,217,433 B2 12/2015 Park et al.
9,228,587 B2 1/2016 Lee et al.
9,249,802 B2 2/2016 Doepker et al.
9,297,383 B2 3/2016 Jin et al.
9,303,642 B2 4/2016 Akei et al.
9,360,011 B2 6/2016 Perevozchikov et al.
9,435,340 B2 9/2016 Doepker et al.
9,494,157 B2 11/2016 Doepker
9,541,084 B2 1/2017 Ignatiev et al.
9,556,862 B2 1/2017 Yoshihiro et al.
9,581,265 B2 2/2017 Sherbeck et al.
9,605,677 B2 3/2017 Heidecker et al.
9,612,042 B2 4/2017 Sjoholm et al.
9,624,928 B2 4/2017 Yamazaki et al.
9,638,191 B2 5/2017 Stover
9,651,043 B2 5/2017 Stover et al.
9,777,730 B2 10/2017 Doepker et al.
9,777,863 B2 10/2017 Higashidozono et al.
9,790,940 B2 10/2017 Doepker et al.
9,797,400 B2 * 10/2017 Yun ..... F04C 27/005
9,850,903 B2 12/2017 Perevozchikov

(56) References Cited

U.S. PATENT DOCUMENTS 9,869,315 B2 1/2018 Jang et al.
9,879,674 B2 1/2018 Akei et al.
9,885,347 B2 2/2018 Lachey et al.
9,920,759 B2 3/2018 Sung et al.
9,926,932 B2 3/2018 Perevozchikov et al.
9,989,057 B2 6/2018 Lochner et al.
10,066,622 B2 9/2018 Pax et al.
10,087,936 B2 10/2018 Pax et al.
10,088,202 B2 10/2018 Huff et al.
10,094,380 B2 10/2018 Doepker et al.
10,180,257 B2 1/2019 Cur et al.
10,197,306 B2 2/2019 Li et al.
10,323,639 B2 * 6/2019 Doepker ..... F04C 18/0215
10,428,818 B2 10/2019 Jin et al.
10,563,891 B2 2/2020 Smerud et al.
10,724,523 B2 7/2020 Wu et al.
10,815,999 B2 10/2020 Jeong
10,830,503 B2 11/2020 Kopko
10,907,633 B2 2/2021 Doepker et al.
10,954,940 B2 3/2021 Akei et al.
10,974,317 B2 4/2021 Ruxanda et al.
11,209,000 B2 12/2021 Moore et al.
11,231,034 B2 1/2022 Funakoshi et al.
11,300,329 B2 4/2022 Yan et al.
11,378,290 B2 7/2022 Locke et al.
11,493,040 B2 11/2022 Zou et al.
11,846,287 B1 12/2023 Gehret et al.
2001/0010800 A1 8/2001 Kohsokabe et al.
2002/0039540 A1 4/2002 Kuroki et al.
2002/0057975 A1 5/2002 Nakajima et al.
2002/0114720 A1 8/2002 Itoh et al.
2003/0044296 A1 3/2003 Chen
2003/0044297 A1 3/2003 Gennami et al.
2003/0186060 A1 10/2003 Rao
2003/0228235 A1 12/2003 Sowa et al.
2004/0126259 A1 7/2004 Choi et al.
2004/0136854 A1 7/2004 Kimura et al.
2004/0146419 A1 7/2004 Kawaguchi et al.
2004/0170509 A1 9/2004 Wehrenberg et al.
2004/0184932 A1 9/2004 Lifson
2004/0197204 A1 10/2004 Yamanouchi et al.
2005/0019177 A1 1/2005 Shin et al.
2005/0019178 A1 1/2005 Shin et al.
2005/0053507 A1 3/2005 Takeuchi et al.
2005/0069444 A1 3/2005 Peyton
2005/0120733 A1 6/2005 Healy et al.
2005/0140232 A1 6/2005 Lee et al.
2005/0142017 A1 6/2005 Liang et al.
2005/0201883 A1 9/2005 Clendenin et al.
2005/0214148 A1 9/2005 Ogawa et al.
2006/0099098 A1 5/2006 Lee et al.
2006/0138879 A1 6/2006 Kusase et al.
2006/0198748 A1 9/2006 Grassbaugh et al.
2006/0228243 A1 10/2006 Sun et al.
2006/0233657 A1 10/2006 Bonear et al.
2007/0003666 A1 1/2007 Gutknecht et al.
2007/0036661 A1 2/2007 Stover
2007/0110604 A1 5/2007 Peyton
2007/0130973 A1 6/2007 Lifson et al.
2007/0148026 A1 6/2007 Higashi
2007/0194261 A1 * 8/2007 Kato ..... H01M 8/04156
251/129.15
2008/0034772 A1 2/2008 Chumley et al.
2008/0115357 A1 5/2008 Li et al.
2008/0138227 A1 6/2008 Knapke
2008/0159892 A1 7/2008 Huang et al.
2008/0159893 A1 7/2008 Caillat
2008/0196445 A1 8/2008 Lifson et al.
2008/0197206 A1 8/2008 Murakami et al.
2008/0223057 A1 9/2008 Lifson et al.
2008/0226483 A1 9/2008 Iwanami et al.
2008/0286118 A1 11/2008 Gu et al.
2008/0305270 A1 12/2008 Uhlianuk et al.
2009/0013701 A1 1/2009 Lifson et al.
2009/0035167 A1 2/2009 Sun
2009/0068048 A1 3/2009 Stover et al.
2009/0071183 A1 3/2009 Stover et al.
2009/0185935 A1 7/2009 Seibel et al.
2009/0191080 A1 7/2009 Ignatiev et al.
2009/0205345 A1 8/2009 Narayanamurthy et al.
2009/0293507 A1 12/2009 Narayanamurthy et al.
2009/0297377 A1 12/2009 Stover et al.
2009/0297378 A1 12/2009 Stover et al.
2009/0297379 A1 12/2009 Stover et al.
2009/0297380 A1 12/2009 Stover et al.
2010/0111741 A1 5/2010 Chikano et al.
2010/0135836 A1 6/2010 Stover et al.
2010/0158731 A1 6/2010 Akei et al.
2010/0209278 A1 8/2010 Tarao et al.
2010/0212311 A1 8/2010 McQuary et al.
2010/0212352 A1 8/2010 Kim et al.
2010/0254841 A1 10/2010 Akei et al.
2010/0300659 A1 12/2010 Stover et al.
2010/0303659 A1 12/2010 Stover et al.
2011/0052437 A1 3/2011 Iitsuka et al.
2011/0135509 A1 6/2011 Fields et al.
2011/0174014 A1 7/2011 Scarcella et al.
2011/0206548 A1 8/2011 Doepker
2011/0232320 A1 9/2011 Satou
2011/0243777 A1 10/2011 Ito et al.
2011/0250085 A1 10/2011 Stover et al.
2011/0293456 A1 12/2011 Seibel et al.
2011/0308762 A1 12/2011 Spero et al.
2012/0009076 A1 1/2012 Kim et al.
2012/0067070 A1 3/2012 Albertson
2012/0107163 A1 5/2012 Monnier et al.
2012/0148433 A1 6/2012 Liang et al.
2012/0183422 A1 7/2012 Bahmata
2012/0195781 A1 8/2012 Stover et al.
2013/0078128 A1 3/2013 Akei
2013/0089448 A1 4/2013 Ginies et al.
2013/0094987 A1 4/2013 Yamashita et al.
2013/0098071 A1 4/2013 Means
2013/0121857 A1 5/2013 Liang et al.
2013/0177465 A1 7/2013 Clendenin et al.
2013/0195707 A1 8/2013 Kozuma et al.
2013/0302198 A1 11/2013 Ginies et al.
2013/0309118 A1 11/2013 Ginies et al.
2013/0315768 A1 11/2013 Le Coat et al.
2014/0023540 A1 1/2014 Heidecker et al.
2014/0024563 A1 1/2014 Heidecker et al.
2014/0037486 A1 2/2014 Stover et al.
2014/0134030 A1 5/2014 Stover et al.
2014/0134031 A1 5/2014 Doepker et al.
2014/0147294 A1 5/2014 Fargo et al.
2014/0154121 A1 6/2014 Doepker
2014/0154124 A1 6/2014 Doepker et al.
2014/0219846 A1 8/2014 Ignatiev et al.
2015/0037184 A1 * 2/2015 Rood ..... F04C 18/0215
418/5
2015/0086404 A1 3/2015 Kiem et al.
2015/0192121 A1 7/2015 Sung et al.
2015/0233375 A1 8/2015 Kim et al.
2015/0275898 A1 10/2015 Ahire et al.
2015/0300353 A1 10/2015 Utpat et al.
2015/0330386 A1 11/2015 Doepker
2015/0345493 A1 12/2015 Lochner et al.
2015/0354719 A1 12/2015 van Beek et al.
2016/0025093 A1 1/2016 Doepker
2016/0025094 A1 1/2016 Ignatiev et al.
2016/0032924 A1 2/2016 Stover
2016/0047380 A1 2/2016 Kim et al.
2016/0053755 A1 2/2016 Taguchi
2016/0053759 A1 2/2016 Choi et al.
2016/0076543 A1 3/2016 Akei et al.
2016/0115954 A1 4/2016 Doepker et al.
2016/0138732 A1 5/2016 Lively et al.
2016/0138879 A1 5/2016 Matsukado et al.
2016/0201673 A1 7/2016 Perevozchikov et al.
2016/0208803 A1 7/2016 Uekawa et al.
2016/0238265 A1 8/2016 Sherbeck et al.
2016/0272047 A1 9/2016 Gan
2017/0002817 A1 1/2017 Stover
2017/0002818 A1 1/2017 Stover

(56) References Cited

U.S. PATENT DOCUMENTS

| | | | |
|---|---|---|---|
| 2017/0030354 | A1 | 2/2017 | Stover |
| 2017/0097108 | A1 | 4/2017 | Huff |
| 2017/0152957 | A1 | 6/2017 | Roche et al. |
| 2017/0241417 | A1 | 8/2017 | Jin et al. |
| 2017/0268510 | A1 | 9/2017 | Stover et al. |
| 2017/0306960 | A1 | 10/2017 | Pax et al. |
| 2017/0314558 | A1 | 11/2017 | Pax et al. |
| 2017/0342978 | A1 | 11/2017 | Doepker |
| 2017/0342983 | A1 | 11/2017 | Jin et al. |
| 2017/0342984 | A1 | 11/2017 | Jin et al. |
| 2018/0023570 | A1 | 1/2018 | Huang et al. |
| 2018/0038369 | A1 | 2/2018 | Doepker et al. |
| 2018/0038370 | A1 | 2/2018 | Doepker et al. |
| 2018/0066656 | A1 | 3/2018 | Perevozchikov et al. |
| 2018/0066657 | A1 | 3/2018 | Perevozchikov et al. |
| 2018/0135625 | A1 | 5/2018 | Naganuma et al. |
| 2018/0149155 | A1 | 5/2018 | Akei et al. |
| 2018/0216618 | A1 | 8/2018 | Jeong |
| 2018/0223823 | A1 | 8/2018 | Ignatiev et al. |
| 2018/0363965 | A1 | 12/2018 | Hayamizu et al. |
| 2019/0040861 | A1 | 2/2019 | Doepker et al. |
| 2019/0041107 | A1 | 2/2019 | Piscopo et al. |
| 2019/0101120 | A1 | 4/2019 | Perevozchikov et al. |
| 2019/0107300 | A1 | 4/2019 | Locke et al. |
| 2019/0162185 | A1 | 5/2019 | Mizushima et al. |
| 2019/0186491 | A1 | 6/2019 | Perevozchikov et al. |
| 2019/0203709 | A1 | 7/2019 | Her et al. |
| 2019/0210425 | A1 | 7/2019 | Azzouz et al. |
| 2019/0277288 | A1 | 9/2019 | Flanigan et al. |
| 2019/0285318 | A1 | 9/2019 | Kopko |
| 2019/0309993 | A1 | 10/2019 | Zaynulin et al. |
| 2019/0353164 | A1 | 11/2019 | Berning et al. |
| 2020/0057458 | A1 | 2/2020 | Taguchi |
| 2020/0291943 | A1 | 9/2020 | McBean et al. |
| 2020/0370808 | A1 | 11/2020 | Feng et al. |
| 2021/0018234 | A1 | 1/2021 | Lingrey et al. |
| 2021/0222788 | A1 | 7/2021 | Willers et al. |
| 2021/0262470 | A1 | 8/2021 | Wei et al. |
| 2022/0065504 | A1 | 3/2022 | Zou |
| 2022/0235774 | A1 | 7/2022 | Cui et al. |
| 2023/0030270 | A1 | 2/2023 | Andersson et al. |
| 2023/0400022 | A1 | 12/2023 | Jo et al. |

FOREIGN PATENT DOCUMENTS

| | | | |
|---|---|---|---|
| CN | 1158944 | A | 9/1997 |
| CN | 1158945 | A | 9/1997 |
| CN | 1177681 | A | 4/1998 |
| CN | 1177683 | A | 4/1998 |
| CN | 1259625 | A | 7/2000 |
| CN | 1286358 | A | 3/2001 |
| CN | 1289011 | A | 3/2001 |
| CN | 1339087 | A | 3/2002 |
| CN | 1349053 | A | 5/2002 |
| CN | 1382912 | A | 12/2002 |
| CN | 1407233 | A | 4/2003 |
| CN | 1407234 | A | 4/2003 |
| CN | 1517553 | A | 8/2004 |
| CN | 1601106 | A | 3/2005 |
| CN | 1680720 | A | 10/2005 |
| CN | 1702328 | A | 11/2005 |
| CN | 2747381 | Y | 12/2005 |
| CN | 1757925 | A | 4/2006 |
| CN | 1828022 | A | 9/2006 |
| CN | 1854525 | A | 11/2006 |
| CN | 1963214 | A | 5/2007 |
| CN | 1995756 | A | 7/2007 |
| CN | 101358592 | A | 2/2009 |
| CN | 101684785 | A | 3/2010 |
| CN | 101761479 | A | 6/2010 |
| CN | 101806302 | A | 8/2010 |
| CN | 101910637 | A | 12/2010 |
| CN | 102076963 | A | 5/2011 |
| CN | 102089525 | A | 6/2011 |
| CN | 102272454 | A | 12/2011 |
| CN | 102400915 | A | 4/2012 |
| CN | 102422024 | A | 4/2012 |
| CN | 102449314 | A | 5/2012 |
| CN | 102705234 | A | 10/2012 |
| CN | 102762866 | A | 10/2012 |
| CN | 202926640 | U | 5/2013 |
| CN | 103502644 | A | 1/2014 |
| CN | 103671125 | A | 3/2014 |
| CN | 203962320 | U | 11/2014 |
| CN | 204041454 | U | 12/2014 |
| CN | 104838143 | A | 8/2015 |
| CN | 105317678 | A | 2/2016 |
| CN | 205533207 | U | 8/2016 |
| CN | 205823629 | U | 12/2016 |
| CN | 205876712 | U | 1/2017 |
| CN | 205876713 | U | 1/2017 |
| CN | 205895597 | U | 1/2017 |
| CN | 106662104 | A | 5/2017 |
| CN | 106979153 | A | 7/2017 |
| CN | 207513832 | U | 6/2018 |
| CN | 207795587 | U | 8/2018 |
| CN | 207974880 | U | 10/2018 |
| CN | 209621603 | U | 11/2019 |
| CN | 209654225 | U | 11/2019 |
| CN | 110529628 | A | 12/2019 |
| CN | 209781195 | U | 12/2019 |
| CN | 116292280 | A | 6/2023 |
| DE | 3917656 | C2 | 11/1995 |
| DE | 102011001394 | A1 | 9/2012 |
| EP | 0256445 | A2 | 2/1988 |
| EP | 0747598 | A2 | 12/1996 |
| EP | 0822335 | A2 | 2/1998 |
| EP | 1067289 | A2 | 1/2001 |
| EP | 1081384 | A2 | 3/2001 |
| EP | 1087142 | A2 | 3/2001 |
| EP | 1182353 | A1 | 2/2002 |
| EP | 1 241 417 | A1 | 9/2002 |
| EP | 1371851 | A2 | 12/2003 |
| EP | 1382854 | A2 | 1/2004 |
| EP | 2151577 | A1 | 2/2010 |
| EP | 1927755 | A3 | 11/2013 |
| FR | 2764347 | A1 | 12/1998 |
| GB | 747832 | A | 4/1956 |
| GB | 2107829 | A | 5/1983 |
| JP | S58214689 | A | 12/1983 |
| JP | S60259794 | A | 12/1985 |
| JP | S62220789 | A | 9/1987 |
| JP | S6385277 | A | 4/1988 |
| JP | S63205482 | A | 8/1988 |
| JP | H01178789 | A | 7/1989 |
| JP | H0281982 | A | 3/1990 |
| JP | H02153282 | A | 6/1990 |
| JP | H03081588 | A | 4/1991 |
| JP | H03233101 | A | 10/1991 |
| JP | H04121478 | A | 4/1992 |
| JP | H04272490 | A | 9/1992 |
| JP | H0610601 | A | 1/1994 |
| JP | H0726618 | B2 | 3/1995 |
| JP | H07293456 | A | 11/1995 |
| JP | H08247053 | A | 9/1996 |
| JP | H08320079 | A | 12/1996 |
| JP | H08334094 | A | 12/1996 |
| JP | H09177689 | A | 7/1997 |
| JP | H11107950 | A | 4/1999 |
| JP | H11166490 | A | 6/1999 |
| JP | 2951752 | B2 | 9/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 3141949 | B2 | 3/2001 |
| JP | 2002202074 | A | 7/2002 |
| JP | 2003074481 | A | 3/2003 |
| JP | 2003074482 | A | 3/2003 |
| JP | 2003106258 | A | 4/2003 |
| JP | 2003214365 | A | 7/2003 |
| JP | 2003227479 | A | 8/2003 |
| JP | 2004239070 | A | 8/2004 |
| JP | 2005264827 | A | 9/2005 |

(56) References Cited

FOREIGN PATENT DOCUMENTS

| | | | |
|---|---|---|---|
| JP | 2006083754 | A | 3/2006 |
| JP | 2006183474 | A | 7/2006 |
| JP | 2007154761 | A | 6/2007 |
| JP | 2007228683 | A | 9/2007 |
| JP | 2008248775 | A | 10/2008 |
| JP | 2008267707 | A | 11/2008 |
| JP | 2013104305 | A | 5/2013 |
| JP | 2013167215 | A | 8/2013 |
| KR | 870000015 | B1 | 1/1987 |
| KR | 10-2001-0009403 | A | 2/2001 |
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 101009266 | B1 | 1/2011 |
| KR | 20120008045 | A | 1/2012 |
| KR | 101192642 | B1 | 10/2012 |
| KR | 20120115581 | A | 10/2012 |
| KR | 20130011864 | A | 1/2013 |
| KR | 20130094646 | A | 8/2013 |
| KR | 20140114212 | A | 9/2014 |
| KR | 10-2018-0094219 | A | 8/2018 |
| KR | 101917697 | B1 | 11/2018 |
| WO | 9515025 | A1 | 6/1995 |
| WO | 0073659 | A1 | 12/2000 |
| WO | 2007046810 | A2 | 4/2007 |
| WO | 2008060525 | A1 | 5/2008 |
| WO | 2009017741 | A1 | 2/2009 |
| WO | 2009155099 | A2 | 12/2009 |
| WO | 2010118140 | A2 | 10/2010 |
| WO | 2011106422 | A2 | 9/2011 |
| WO | 2012114455 | A1 | 8/2012 |
| WO | 2015187816 | A1 | 12/2015 |
| WO | 2017071641 | A1 | 5/2017 |
| WO | 2019128793 | A1 | 7/2019 |
| WO | 2019165254 | A1 | 8/2019 |
| WO | 2019222535 | A1 | 11/2019 |
| WO | 2020-209979 | A2 | 10/2020 |
| WO | 2021007528 | A1 | 1/2021 |

OTHER PUBLICATIONS

Office Action regarding Chinese Patent Application No. 201811168307.7, dated Mar. 27, 2020. Translation provided by Unitalen Attorneys at Law.
Office Action regarding European Patent Application No. 13859308.2, dated Mar. 4, 2020.
Office Action regarding Korean Patent Application No. 10-2018-0159231, dated Apr. 7, 2020. Translation provided by KS Koryo International IP Law Firm.
Notice of Allowance regarding U.S. Appl. No. 15/682,599, dated Apr. 22, 2020.
Office Action regarding Chinese Patent Application No. 201780055443.2, dated Apr. 14, 2020. Translation provided by Unitalen Attorneys At Law.
Notice of Allowance regarding U.S. Appl. No. 15/831,423, dated May 20, 2020.
Restriction Requirement regarding U.S. Appl. No. 16/147,920, dated Jun. 25, 2020.
Notice of Allowance regarding U.S. Appl. No. 15/692,844, dated Jun. 4, 2020.
Office Action regarding U.S. Appl. No. 16/154,406, dated Jun. 29, 2020.
Restriction Requirement regarding U.S. Appl. No. 16/154,844, dated Jul. 2, 2020.
International Search Report regarding International Application No. PCT/US2020/022030, dated Jul. 2, 2020.
Written Opinion of the International Searching Authority regarding International Application No. PCT/US2020/022030, dated Jul. 2, 2020.
Office Action regarding U.S. Appl. No. 16/177,902, dated Jul. 23, 2020.
Office Action regarding U.S. Appl. No. 15/881,016, dated Jul. 21, 2020.
Office Action regarding Chinese Patent Application No. 201811480347.5, dated Jul. 21, 2020. Translation provided by Unitalen Attorneys at Law.
Notice of Allowance regarding U.S. Appl. No. 16/154,406, dated Oct. 2, 2020.
Office Action regarding U.S. Appl. No. 16/154,844, dated Oct. 5, 2020.
Office Action regarding U.S. Appl. No. 16/147,920, dated Sep. 25, 2020.
Notice of Allowance regarding U.S. Appl. No. 15/881,016, dated Nov. 17, 2020.
Notice of Allowance regarding U.S. Appl. No. 16/177,902, dated Nov. 27, 2020.
Notice of Allowance regarding U.S. Appl. No. 16/147,920, dated Feb. 2, 2021.
Notice of Allowance regarding U.S. Appl. No. 16/154,844, dated Feb. 10, 2021.
Heatcraft RPD; How and Why we use Capacity Control; dated Jan. 17, 2016; 12 Pages.
Non-Final Office Action regarding U.S. Appl. No. 17/176,080 dated Mar. 30, 2022.
First Chinese Office Action & Search Report regarding Application No. 201980040745.1 dated Jan. 6, 2022. English translation provided by Unitalen Attorneys at Law.
Non-Final Office Action regarding U.S. Appl. No. 17/388,923 dated Jun. 9, 2022.
Notice of Allowance regarding U.S. Appl. No. 17/157,588 dated Jun. 16, 2022.
Final Office Action regarding U.S. Appl. No. 17/176,080 dated Aug. 12, 2022.
Advisory Action regarding U.S. Appl. No. 17/176,080 dated Oct. 17, 2022.
Performance of the Use of Plastics in Oil-Free Scroll Compressors, Shaffer et al., 2012.
Notice of Allowance regarding U.S. Appl. No. 17/176,080 dated Dec. 15, 2022.
Corrected Notice of Allowance regarding U.S. Appl. No. 17/176,080 dated Dec. 21, 2022.
Notice of Allowance regarding U.S. Appl. No. 17/176,080 dated Feb. 8, 2023.
Office Action mailed Jan. 19, 2023, in U.S. Appl. No. 17/196,119.
Office Action mailed Mar. 9, 2023, in U.S. Appl. No. 17/835,048.
Notice of Allowance regarding U.S. Appl. No. 17/196,119 dated Apr. 26, 2023.
Non-Final Office Action regarding U.S. Appl. No. 17/886,047 dated May 17, 2023.
Non-Final Office Action regarding U.S. Appl. No. 17/980,798 dated May 24, 2023.
Office Action regarding Chinese Patent Application No. 2022109807542, dated May 15, 2023. Translation provided by Unitalen Attorneys at Law.
Office Action regarding European Patent Application No. 198040792, dated Jun. 13, 2023.
Notice of Allowance regarding U.S. Appl. No. 17/866,047 dated Aug. 18, 2023.
Notice of Allowance regarding U.S. Appl. No. 17/980,798 dated Sep. 20, 2023.
Final Office Action regarding U.S. Appl. No. 17/835,048 dated Aug. 10, 2023.
International Search Report and Written Opinion regarding App. No. PCT/US2023/023852 dated Sep. 20, 2023.
International Search Report and Written Opinion in corresponding Application No. PCT/US2023/029860 dated Nov. 21, 2023.
International Search Report and Written Opinion in corresponding Application No. PCT/US2022/033029 dated Dec. 6, 2022.
International Search Report and Written Opinion regarding Application No. PCT/US2022/033029 dated Dec. 6, 2022.
International Search Report and Written Opinion regarding Application No. PCT/US2023/029860 dated Nov. 21, 2023.

(56) References Cited

OTHER PUBLICATIONS

Liegeois, Olivier and Winandy, Eric, "Scroll Compressors for Dedicated Heat Pumps: Development and Performance Comparison" (2008). International Compressor Engineering Conference. Paper 1906.
Itoh, T.; Fujitani, M.; and Takeda, K., "Investigation of Discharge Flow Pulsation in Scroll Crompressors" (1994). International Compressor Engineering Conference. Paper 1056.
Toyama, T.; Nishikawa, Y.; Yoshida, Y.; Hiodoshi, S.; and Shibamoto, Y., "Reduction Of Noise And Over-Compression Loss By Scroll Compressor With Modified Discharge Check Valve" (2002). International Compressor Engineering Conference. Paper 1587.
Yanagisawa, M.; Uematsu, T.; Hiodoshi, S.; Saito, M.; and Era, S., "Noise Reduction Technology For Inverter Controlled Scroll Compressors" (2002). International Compressor Engineering Conference. Paper 1578.
Lee, J. K.; Lee, S. J.; Lee, D. S.; Lee, B. C.; and Lee, U. S., "Identification and Reduction of Noise in a Scroll Compressor" (2000). International Compressor Engineering Conference. Paper 1496.
Office Action regarding U.S. Appl. No. 17/835,048, dated Nov. 24, 2023.
Notice of Allowance regarding U.S. Appl. No. 18/115,355 dated Jan. 4, 2024.
Office Action regarding Chinese Patent Application No. 201010224582.3, dated Apr. 17, 2012. Translation provided by Unitalen Attorneys at Law.
Office Action regarding Indian Patent Application No. 1071/KOL/2007, dated Apr. 27, 2012.
Office Action regarding U.S. Appl. No. 13/036,529, dated Aug. 22, 2012.
International Search Report regarding International Application No. PCT/US2015/042479, dated Oct. 23, 2015.
Written Opinion of the International Searching Authority regarding International Application No. PCT/US2015/042479, dated Oct. 23, 2015.
Restriction Requirement regarding U.S. Appl. No. 14/809,786, dated Aug. 16, 2017.
International Search Report regarding International Application No. PCT/US2017/050525, dated Dec. 28, 2017.
Written Opinion of the International Searching Authority regarding International Application No. PCT/US2017/050525, dated Dec. 28, 2017.
Office Action regarding U.S. Appl. No. 14/809,786, dated Jan. 11, 2018.
Office Action regarding Chinese Patent Application No. 201580041209.5, dated Jan. 17, 2018. Translation provided by Unitalen Attorneys at Law.
Office Action regarding Chinese Patent Application No. 201710795228.8, dated Sep. 5, 2018. Translation provided by Unitalen Attorneys at Law.
Office Action regarding Chinese Patent Application No. 201580029636.1, dated Oct. 8, 2018. Translation provided by Unitalen Attorneys at Law.
Office Action regarding U.S. Appl. No. 15/186,151, dated Nov. 1, 2018.
Luckevich, Mark, "MEMS microvalves: the new valve world." Valve World, May 2007, pp. 79-83.
Office Action regarding Korean Patent Application No. 10-2017-7033995, dated Nov. 29, 2018. Translation provided by KS Koryo International IP Law Firm.
Office Action regarding Indian Patent Application No. 1306/MUMNP/2015, dated Dec. 31, 2018.
Notice of Allowance regarding U.S. Appl. No. 15/187,225, dated Jan. 3, 2019.
Notice of Allowance regarding U.S. Appl. No. 15/186,092, dated Dec. 20, 2018.
Notice of Allowance regarding U.S. Appl. No. 15/784,458, dated Feb. 7, 2019.
Notice of Allowance regarding U.S. Appl. No. 15/784,540, dated Feb. 7, 2019.
Office Action regarding Chinese Patent Application No. 201610516097.0, dated Jun. 27, 2017. Translation provided by Unitalen Attorneys at Law.
Search Report regarding European Patent Application No. 18198310.7, dated Feb. 27, 2019.
Office Action regarding Chinese Patent Application No. 201610499158.7, dated Feb. 1, 2019. Translation provided by Unitalen Attorneys at Law.
Office Action regarding Chinese Patent Application No. 201180010366.1, dated Jun. 4, 2014. Translation provided by Unitalen Attorneys at Law.
Notice of Allowance regarding U.S. Appl. No. 15/186,151, dated Mar. 19, 2019.
Office Action regarding Chinese Patent Application No. 201710795228.8, dated Apr. 29, 2019. Translation provided by Unitalen Attorneys at Law.
Office Action regarding U.S. Appl. No. 15/587,735, dated May 17, 2019.
Notice of Allowance regarding U.S. Appl. No. 15/187,225, dated May 2, 2019.
Notice of Allowance regarding U.S. Appl. No. 15/186,092, dated Apr. 19, 2019.
Office Action regarding European Patent Application No. 11747996.4, dated Jun. 26, 2019.
Office Action regarding Chinese Patent Application No. 201811011292.3, dated Jun. 21, 2019. Translation provided by Unitalen Attorneys at Law.
Notice of Allowance regarding U.S. Appl. No. 15/186,151, dated Jul. 25, 2019.
Notice of Allowance regarding U.S. Appl. No. 15/587,735, dated Aug. 23, 2019.
Office Action regarding U.S. Appl. No. 15/692,844, dated Sep. 20, 2019.
Office Action regarding Chinese Patent Application No. 201610499158.7, dated Aug. 1, 2019. Translation provided by Unitalen Attorneys at Law.
Office Action regarding Chinese Patent Application No. 201780055443.2, dated Sep. 2, 2019. Translation provided by Unitalen Attorneys at Law.
Restriction Requirement regarding U.S. Appl. No. 15/682,599, dated Aug. 14, 2019.
Office Action regarding Chinese Patent Application No. 201811168307.7, dated Aug. 12, 2019. Translation provided by Unitalen Attorneys at Law.
International Search Report regarding International Application No. PCT/US2019/032718, dated Aug. 23, 2019.
Written Opinion of the International Searching Authority regarding International Application No. PCT/US2019/032718, dated Aug. 23, 2019.
Office Action regarding European Patent Application No. 11747996.4, dated Nov. 5, 2019.
Notice of Allowance regarding U.S. Appl. No. 15/186,151, dated Nov. 14, 2019.
Office Action regarding Chinese Patent Application No. 201710795228.8, dated Oct. 28, 2019. Translation provided by Unitalen Attorneys at Law.
Office Action regarding U.S. Appl. No. 15/682,599, dated Jan. 24, 2020.
Office Action regarding U.S. Appl. No. 15/881,016, dated Jan. 23, 2020.
Office Action regarding U.S. Appl. No. 15/831,423, dated Jan. 31, 2020.
Office Action regarding Chinese Patent Application No. 201811480347.5, dated Jan. 10, 2020. Translation provided by Unitalen Attorneys at Law.
Office Action regarding European Patent Application No. 11747996.4, dated Jan. 14, 2020.
Office Action regarding Indian Patent Application No. 2043/MUMNP/2011, dated Nov. 27, 2019.

(56) References Cited

OTHER PUBLICATIONS

Office Action regarding Chinese Patent Application No. 201811541653.5, dated Jan. 10, 2020. Translation provided by Unitalen Attorneys at Law.
Non-Final Office Action for U.S. Appl. No. 18/115,355 dated Jul. 18, 2023.
International Search Report Regarding Application PCT/US2023/015116-WO-POA Dated Sep. 5, 2023.
International Search Report regarding International Application No. PCT/US2011/025921, dated Oct. 7, 2011.
Written Opinion of the International Search Authority regarding International Application No. PCT/US2011/025921, dated Oct. 7, 2011.
Written Opinion of the International Searching Authority regarding International Application No. PCT/US2010/030248, dated Nov. 26, 2010.
International Search Report regarding International Application No. PCT/US2010/030248, dated Nov. 26, 2010.
Office Action regarding U.S. Appl. No. 13/181,065, dated Nov. 9, 2012.
International Search Report regarding International Application No. PCT/US2013/051678, dated Oct. 21, 2013.
Written Opinion of the International Searching Authority regarding International Application No. PCT/US2013/051678, dated Oct. 21, 2013.
Office Action regarding U.S. Appl. No. 11/645,288, dated Nov. 30, 2009.
Search Report regarding European Patent Application No. 07254962.9, dated Mar. 12, 2008.
Office Action regarding Chinese Patent Application No. 200710160038.5, dated Jul. 8, 2010. Translation provided by Unitalen Attorneys At Law.
Office Action regarding Chinese Patent Application No. 200710160038.5, dated Jan. 31, 2012. Translation provided by Unitalen Attorneys At Law.
Office Action regarding Chinese Patent Application No. 201080020243.1, dated Nov. 5, 2013. Translation provided by Unitalen Attorneys At Law.
International Search Report regarding International Application No. PCT/US2013/069462, dated Feb. 21, 2014.
Written Opinion of the International Searching Authority regarding International Application No. PCT/US2013/069462, dated Feb. 21, 2014.
International Search Report regarding International Application No. PCT/US2013/070981, dated Mar. 4, 2014.
Written Opinion of the International Searching Authority regarding International Application No. PCT/US2013/070981, dated Mar. 4, 2014.
International Search Report regarding International Application No. PCT/US2013/069456, dated Feb. 18, 2014.
Written Opinion of the International Searching Authority regarding International Application No. PCT/US2013/069456, dated Feb. 18, 2014.
International Search Report regarding International Application No. PCT/US2013/070992, dated Feb. 25, 2014.
Written Opinion of the International Searching Authority regarding International Application No. PCT/US2013/070992, dated Feb. 25, 2014.
Office Action regarding Chinese Patent Application No. 201180010366.1, dated Dec. 31, 2014. Translation provided by Unitalen Attorneys At Law.
Office Action regarding U.S. Appl. No. 14/081,390, dated Mar. 27, 2015.
Search Report regarding European Patent Application No. 10762374.6, dated Jun. 16, 2015.
Office Action regarding U.S. Appl. No. 14/060,240, dated Aug. 12, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.
Office Action regarding U.S. Appl. No. 14/073,293, dated Sep. 25, 2015.
Restriction Requirement regarding U.S. Appl. No. 14/060,102, dated Oct. 7, 2015.
Notice of Allowance regarding U.S. Appl. No. 14/060,240, dated Dec. 1, 2015.
Office Action regarding Chinese Patent Application No. 201410461048.2, dated Nov. 30, 2015. Translation provided by Unitalen Attorneys at Law.
Office Action regarding U.S. Appl. No. 14/073,293, dated Jan. 29, 2016.
Restriction Requirement regarding U.S. Appl. No. 14/060,102, dated Mar. 16, 2016.
Office Action regarding Chinese Patent Application No. 201410460792.0, dated Feb. 25, 2016. Translation provided by Unitalen Attorneys at Law.
Advisory Action regarding U.S. Appl. No. 14/073,293, dated Apr. 18, 2016.
Office Action regarding Chinese Patent Application No. 201380059666.8, dated Apr. 5, 2016. Translation provided by Unitalen Attorneys At Law.
Office Action regarding Chinese Patent Application No. 201380062614.6, dated Apr. 5, 2016. Translation provided by Unitalen Attorneys At Law.
Office Action regarding Chinese Patent Application No. 201380062657.4, dated May 4, 2016. Translation provided by Unitalen Attorneys at Law.
Office Action regarding Chinese Patent Application No. 201380059963.2, dated May 10, 2016. Translation provided by Unitalen Attorneys at Law.
Office Action regarding U.S. Appl. No. 14/060,102, dated Jun. 14, 2016.
Office Action regarding U.S. Appl. No. 14/846,877, dated Jul. 15, 2016.
Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.
Office Action regarding U.S. Appl. No. 14/294,458, dated Aug. 19, 2016.
Office Action regarding Chinese Patent Application No. 201410460792.0, dated Oct. 21, 2016. Translation provided by Unitalen Attorneys At Law.
Search Report regarding European Patent Application No. 11747996.4, dated Nov. 7, 2016.
Office Action regarding Chinese Patent Application No. 201380059666.8, dated Nov. 23, 2016. Translation provided by Unitalen Attorneys at Law.
Office Action regarding U.S. Appl. No. 14/060,102, dated Dec. 28, 2016.
Office Action regarding U.S. Appl. No. 15/156,400, dated Feb. 23, 2017.
Office Action regarding U.S. Appl. No. 14/294,458, dated Feb. 28, 2017.
Advisory Action regarding U.S. Appl. No. 14/060,102, dated Mar. 3, 2017.
Office Action regarding U.S. Appl. No. 14/663,073, dated Apr. 11, 2017.
Office Action regarding Chinese Patent Application No. 201410460792.0, dated Apr. 24, 2017. Translation provided by Unitalen Attorneys at Law.
Office Action regarding U.S. Appl. No. 14/946,824, dated May 10, 2017.
Advisory Action regarding U.S. Appl. No. 14/294,458, dated Jun. 9, 2017.

(56) References Cited

OTHER PUBLICATIONS

Office Action regarding Chinese Patent Application No. 201610703191.7, dated Jun. 13, 2017. Translation provided by Unitalen Attorneys at Law.
Office Action regarding Indian Patent Application No. 2043/MUMNP/2011, dated Jul. 28, 2017.
International Search Report regarding International Application No. PCT/CN2016/103763, dated Jan. 25, 2017.
Written Opinion of the International Searching Authority regarding International Application No. PCT/CN2016/103763, dated Jan. 25, 2017.
Office Action regarding U.S. Appl. No. 14/294,458, dated Sep. 21, 2017.
Office Action regarding U.S. Appl. No. 14/757,407, dated Oct. 13, 2017.
Office Action regarding Chinese Patent Application No. 201410460792.0, dated Nov. 1, 2017. Translation provided by Unitalen Attorneys At Law.
Office Action regarding Chinese Patent Application No. 201610158216.X, dated Oct. 30, 2017. Translation provided by Unitalen Attorneys at Law.
Office Action regarding Chinese Patent Application No. 201610512702.7, dated Dec. 20, 2017. Partial translation provided by Unitalen Attorneys at Law.
Office Action regarding Chinese Patent Application No. 201610499158.7, dated Jan. 9, 2018. Translation provided by Unitalen Attorneys at Law.
Office Action regarding Chinese Patent Application No. 201580029636.1, dated Jan. 17, 2018. Translation provided by Unitalen Attorneys at Law.
Office Action regarding U.S. Appl. No. 15/651,471, dated Feb. 23, 2018.
Office Action regarding U.S. Appl. No. 15/646,654, dated Feb. 9, 2018.
Office Action regarding Indian Patent Application No. 1907/MUMNP/2012, dated Feb. 26, 2018.
Restriction Requirement regarding U.S. Appl. No. 15/784,458, dated Apr. 5, 2018.
Restriction Requirement regarding U.S. Appl. No. 15/186,092, dated Apr. 3, 2018.
Office Action regarding U.S. Appl. No. 15/186,151, dated May 3, 2018.
Restriction Requirement regarding U.S. Appl. No. 15/187,225, dated May 15, 2018.
Notice of Allowance regarding U.S. Appl. No. 14/757,407, dated May 24, 2018.
Office Action regarding Chinese Patent Application No. 201610930347.5, dated May 14, 2018. Translation provided by Unitalen Attorneys at Law.
Office Action regarding U.S. Appl. No. 15/186,092, dated Jun. 29, 2018.
Notice of Allowance regarding U.S. Appl. No. 15/646,654, dated Jul. 11, 2018.
Notice of Allowance regarding U.S. Appl. No. 15/651,471, dated Jul. 11, 2018.
Office Action regarding Korean Patent Application No. 10-2016-7034539, dated Apr. 11, 2018. Translation provided by Y.S. Chang & Associates.
Office Action regarding Chinese Patent Application No. 201610158216.X, dated Jun. 13, 2018. Translation provided by Unitalen Attorneys at Law.
Office Action regarding U.S. Appl. No. 15/784,540, dated Jul. 17, 2018.
Office Action regarding European Patent Application No. 13859308.2, dated Jun. 22, 2018.
Office Action regarding U.S. Appl. No. 15/784,458, dated Jul. 19, 2018.
Restriction Requirement regarding U.S. Appl. No. 15/587,735, dated Jul. 23, 2018.
Interview Summary regarding U.S. Appl. No. 15/186,092, dated Aug. 14, 2018.
Office Action regarding U.S. Appl. No. 15/187,225, dated Aug. 27, 2018.
Office Action regarding Indian Patent Application No. 1307/MUMNP/2015, dated Sep. 12, 2018.
Office Action regarding Chinese Patent Application No. 201610499158.7, dated Aug. 1, 2018. Translation provided by Unitalen Attorneys at Law.
Office Action regarding Korean Patent Application No. 10-2016-7034539, dated Sep. 6, 2018. Translation provided by Y.S. Chang & Associates.
Office Action regarding U.S. Appl. No. 15/587,735, dated Oct. 9, 2018.
Office Action regarding U.S. Appl. No. 11/522,250, dated Aug. 1, 2007.
Office Action regarding Chinese Patent Application No. 200710153687.2, dated Mar. 6, 2009. Translation provided by CCPIT Patent and Trademark Law Office.
Office Action regarding U.S. Appl. No. 12/103,265, dated May 27, 2009.
Office Action regarding U.S. Appl. No. 12/103,265, dated Dec. 17, 2009.
Office Action regarding Korean Patent Application No. 10-2007-0093478, dated Feb. 25, 2010. Translation provided by Y.S. Chang & Associates.
Office Action regarding U.S. Appl. No. 12/103,265, dated Jun. 15, 2010.
Office Action regarding Korean Patent Application No. 10-2007-0093478, dated Aug. 31, 2010. Translation provided by Y.S. Chang & Associates.
Advisory Action regarding U.S. Appl. No. 12/103,265, dated Sep. 17, 2010.
International Search Report and Written Opinion regarding Application No. PCT/US2023/086010, dated Apr. 24, 2024.
Final Office Action regarding U.S. Appl. No. 17/835,048, dated May 3, 2024.
Non-Final Office Action regarding U.S. Appl. No. 18/381,884, dated May 10, 2024.
Notice of Allowance regarding U.S. Appl. No. 18/541,828 dated Aug. 12, 2024.
Notice of Allowance regarding U.S. Appl. No. 18/533,121 dated Aug. 14, 2024.
Non-Final Office Action regarding U.S. Appl. No. 17/830,026 dated Jul. 9, 2024.
Notice of Allowance regarding U.S. Appl. No. 18/381,884 dated Sep. 4, 2024.
Carrier, Optimal Cooling or Optimized Savings?, Mar. 2017.
Khushairi et al, A Study on the Optimization of Control Strategy of a Thermal Energy Storage System for Building Air-Conditioning, 2011.
International Search Report and Written Opinion of the ISA for PCT/US2022/029616, ISA/KR, mailed Aug. 30, 2022.
Non-Final Office Action regarding U.S. Appl. No. 17/324,696 dated Nov. 17, 2022.
Non-Final Office Action regarding U.S. Appl. No. 17/324,696 dated May 22, 2023.
Final Office Action regarding U.S. Appl. No. 17/324,696 dated Nov. 9, 2023.
Chen, Multi-way valve, thermal management system and electric automobile, Dec. 13, 2019.
Lee, One-piece type multiple unit valve device of water pump for vehicle, English Translation, Oct. 16, 2018.
Notice of Allowance regarding U.S. Appl. No. 17/830,026 dated Jan. 13, 2025.
Search Report regarding European Patent Application No. 241933761, dated Feb. 10, 2025.
Search Report refarding European Patent Application No. 242194223, dated May 30, 2025.

* cited by examiner

COMPRESSOR WITH SHUTDOWN ASSEMBLY

CROSS-REFERENCE TO RELATED APPLICATIONS

This application claims the benefit and priority of Indian Patent Application No. 202221076341, filed Dec. 28, 2022. The entire disclosure of the above application is incorporated herein by reference.

FIELD

The present disclosure relates to a compressor with a shutdown assembly.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., a refrigerant) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure and is not a comprehensive disclosure of its full scope or all of its features.

In one form, the present disclosure provides a compressor that may include first and second scrolls, and a shutdown assembly. The first scroll may be an orbiting scroll. The second scroll may be a non-orbiting scroll. The first and second scrolls have first and second spiral wraps, respectively, that meshingly engage each other to form a plurality of moving pockets. The second scroll includes a discharge passage that receives compressed working fluid from one of the pockets defined by the first and second spiral wraps. The shutdown assembly may include a valve housing and a valve member. The valve housing may be attached to the second scroll (i.e., the valve housing may be integrally formed with a part of the second scroll or the valve housing may be formed separately from the second scroll and mounted thereto). The valve housing may include a first aperture that receives working fluid from the discharge passage. The valve member may include a valve stem and a valve head. The valve stem may be movably received in a second aperture of the valve housing and has a smaller diameter than a diameter of the valve head. The valve member may be movable between a closed position in which the valve head restricts flow through the discharge passage and an open position in which the valve head allows flow through the discharge passage.

In some configurations of the compressor of the above paragraph, the valve head includes a first side that contacts a surface of the second scroll when the valve member is in the closed position, wherein the valve head includes a second side opposite the first side, and wherein a chamfer is formed on the second side at an outer periphery of the valve head.

In some configurations of the compressor of either of the above paragraphs, a raised boss is formed on the second side of the valve head, and wherein the raised boss is disposed radially between the valve stem and the chamfer.

In some configurations of the compressor of any one or more of the above paragraphs, the first side of the valve head includes a protrusion that extends into the discharge passage when the valve member is in the closed position.

In some configurations of the compressor of any one or more of the above paragraphs, the valve member includes a groove formed in an outer diametrical surface of the valve stem.

In some configurations of the compressor of any one or more of the above paragraphs, the groove is an annular groove that encircles a longitudinal axis of the valve stem.

In some configurations of the compressor of any one or more of the above paragraphs, the groove is an axially extending groove and extends in a direction parallel to a longitudinal axis of the valve stem.

In some configurations of the compressor of any one or more of the above paragraphs, the valve member includes at least another axially extending groove formed in the outer diametrical surface of the valve stem and extending in the direction parallel to the longitudinal axis of the valve stem.

In some configurations of the compressor of any one or more of the above paragraphs, a third aperture extends through at least a portion of the valve stem.

In some configurations of the compressor of any one or more of the above paragraphs, the third aperture extends through the valve head.

In another form, the present disclosure provides a compressor that includes an orbiting scroll, a non-orbiting scroll, and a discharge valve member. The non-orbiting scroll is meshingly engaged with the orbiting scroll and may include a lower scroll piece and an upper scroll piece that is mounted to the lower scroll piece. The upper scroll piece may include a central hub that defines a valve housing having a valve guide and a plurality of first apertures disposed around the valve guide. The discharge valve member may include a valve stem and a valve head disposed at an axial end of the valve stem. The valve head is disposed in a recess defined by a side of the upper scroll piece that faces the lower scroll piece. The valve stem may be movably received in a second aperture formed in the valve guide and has a smaller diameter than a diameter of the valve head. The valve member may be movable relative to the upper and lower scroll pieces between a closed position in which the valve head blocks a discharge passage in the lower scroll piece to restrict fluid flow therethrough and an open position in which the valve head allows fluid flow through the discharge passage.

In some configurations of the compressor of the above paragraph, the valve head includes a first side that contacts a surface of the lower scroll piece when the valve member is in the closed position, wherein the valve head includes a second side opposite the first side, and wherein a chamfer is formed on the second side at an outer periphery of the valve head.

In some configurations of the compressor of either of the above paragraphs, a raised boss is formed on the second side of the valve head, and wherein the raised boss is disposed radially between the valve stem and the chamfer.

In some configurations of the compressor of any one or more of the above paragraphs, the first side of the valve head includes a protrusion that extends into the discharge passage when the valve member is in the closed position.

In some configurations of the compressor of any one or more of the above paragraphs, the valve member includes a groove formed in an outer diametrical surface of the valve stem.

In some configurations of the compressor of any one or more of the above paragraphs, the groove is an annular groove that encircles a longitudinal axis of the valve stem.

In some configurations of the compressor of any one or more of the above paragraphs, the groove is an axially extending groove and extends in a direction parallel to a longitudinal axis of the valve stem.

In some configurations of the compressor of any one or more of the above paragraphs, the valve member includes at least another axially extending groove formed in the outer diametrical surface of the valve stem and extending in the direction parallel to the longitudinal axis of the valve stem.

In some configurations of the compressor of any one or more of the above paragraphs, a third aperture extends through at least a portion of the valve stem.

In some configurations of the compressor of any one or more of the above paragraphs, the third aperture extends through the valve head.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
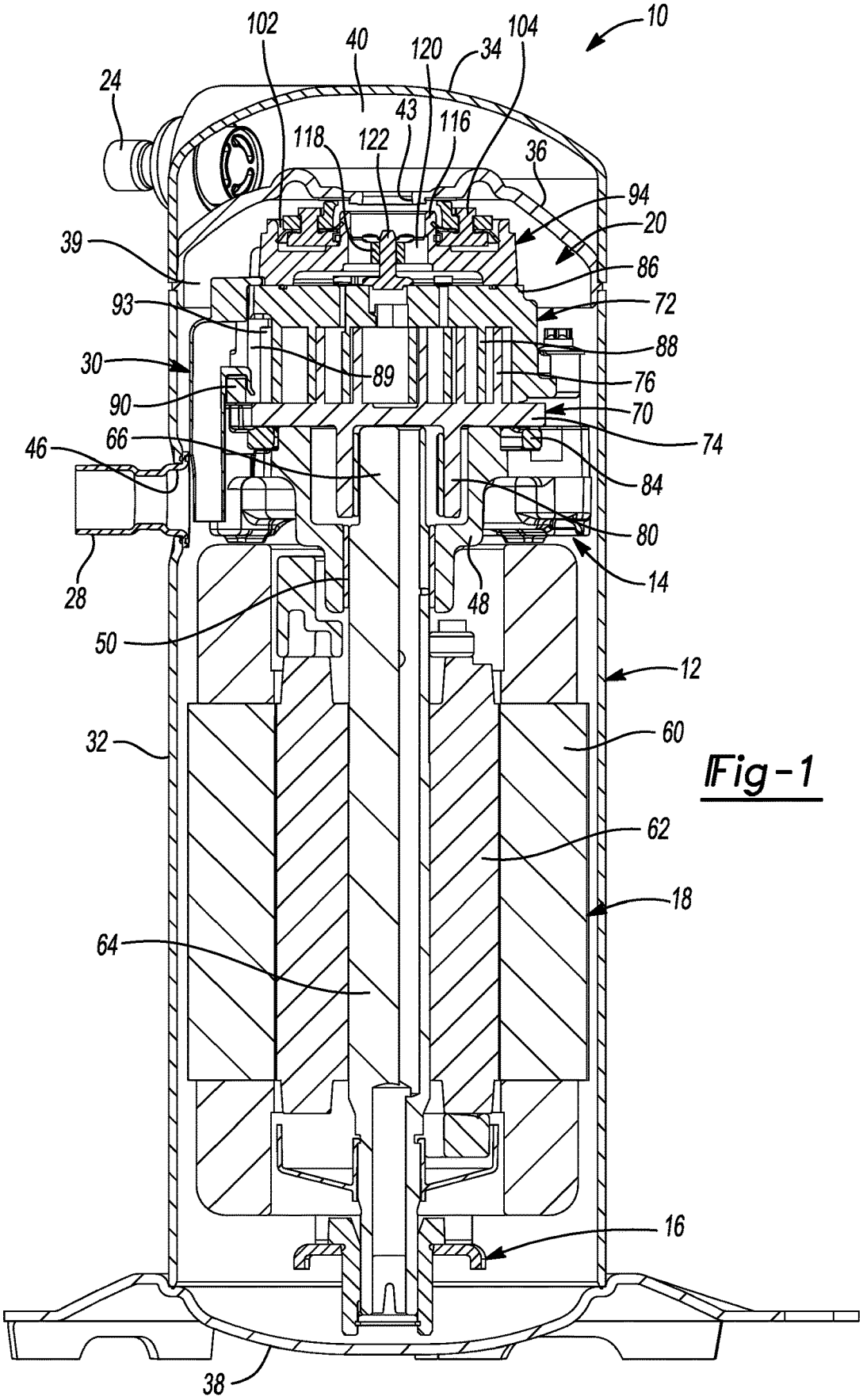
FIG. 1 is a cross-sectional view of a compressor having a shutdown assembly including a discharge valve member.

Example embodiments will now be described more fully with reference to the accompanying drawings.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
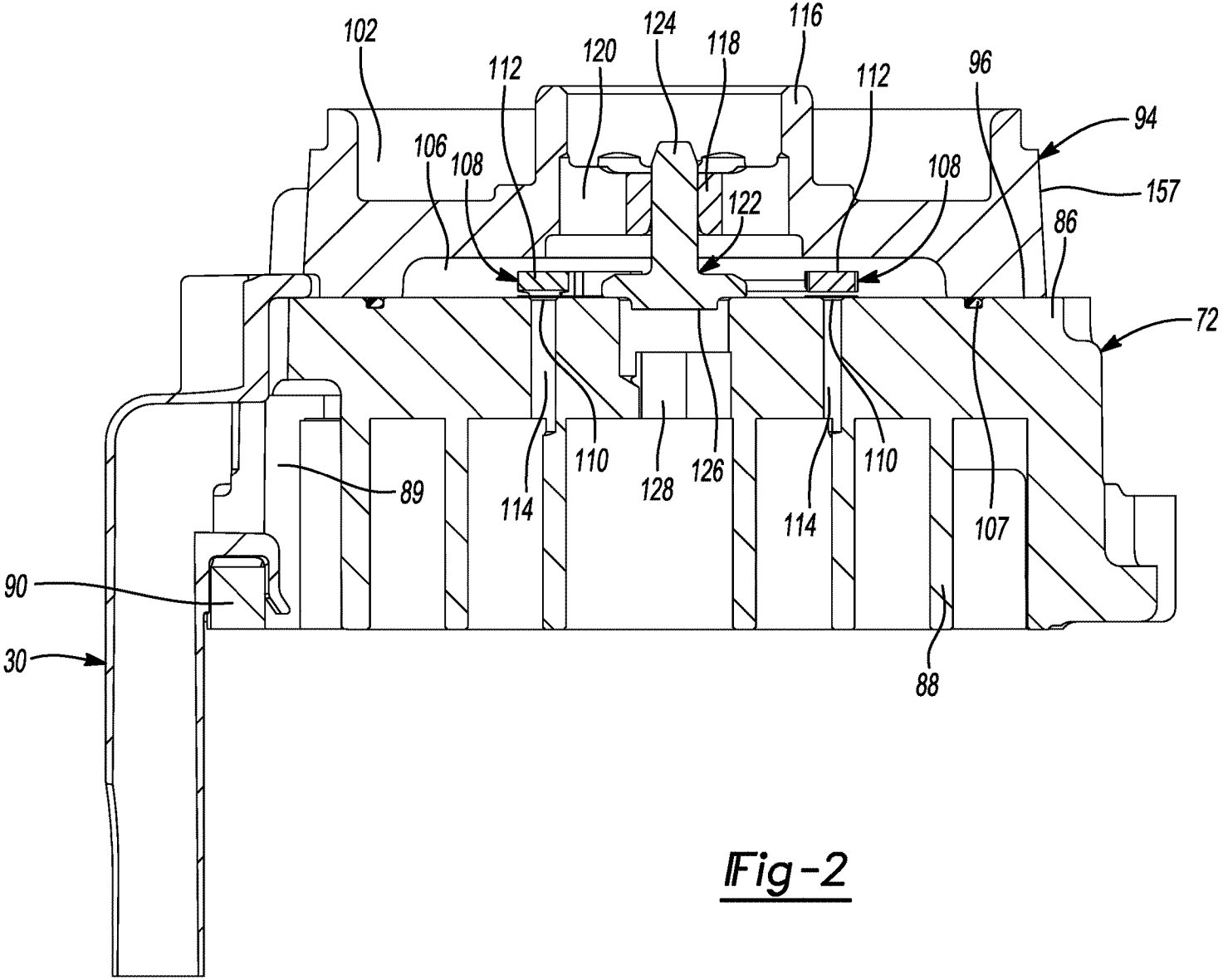
FIG. 2 is a cross-sectional view of a non-orbiting scroll and the shutdown assembly.
Figure 3:
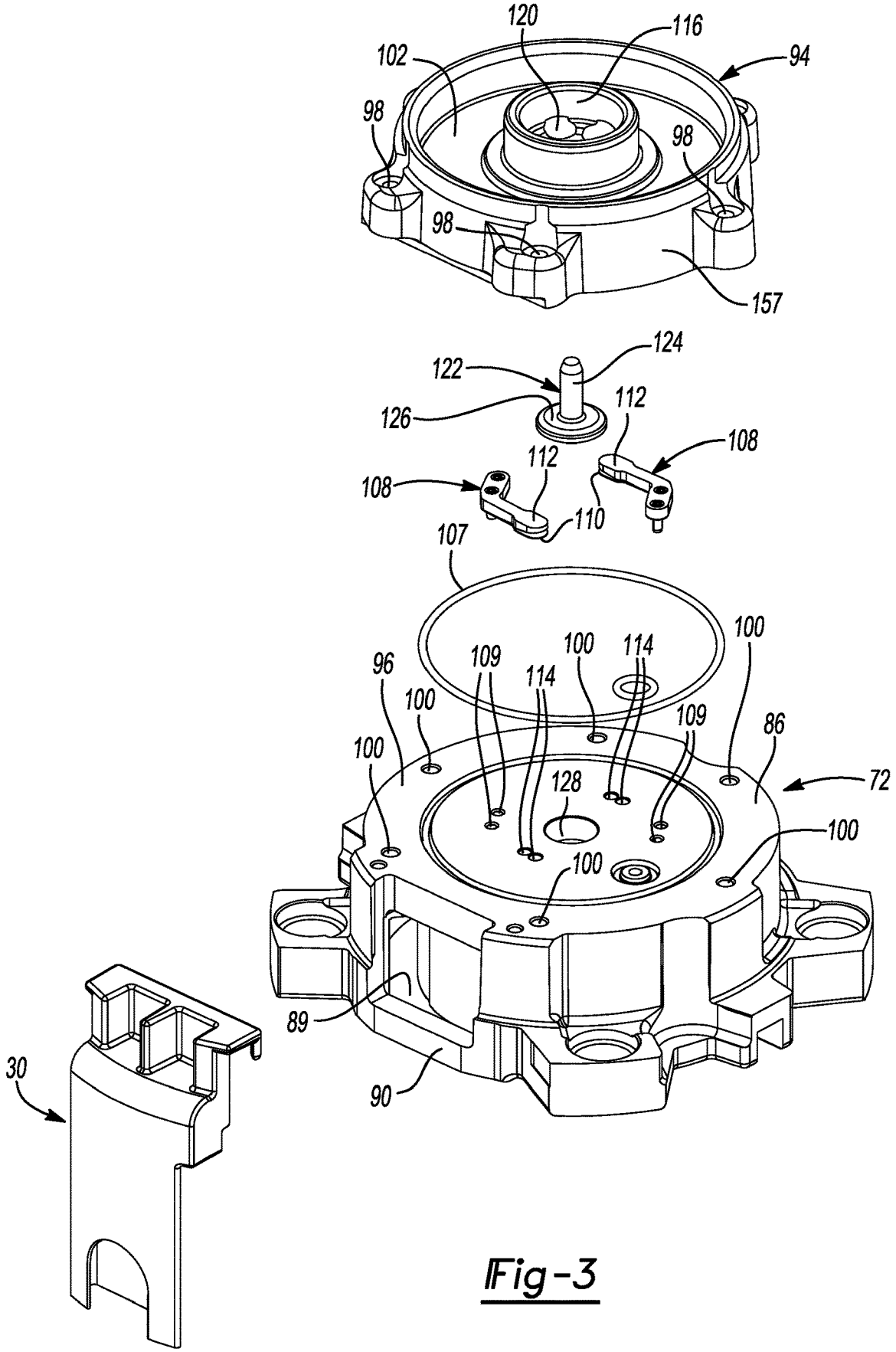
FIG. 3 is an exploded view of the non-orbiting scroll and the shutdown assembly of FIG. 2.

With reference to FIGS. 1-3, a compressor 10 is provided that may include a hermetic shell assembly 12, first and second bearing housing assemblies 14, 16, a motor assembly 18, a compression mechanism 20, a discharge port or fitting 24, a suction port or fitting 28, and a suction conduit (or suction funnel) 30.

As shown in FIG. 1, the shell assembly 12 may form a compressor housing and may include a cylindrical shell 32, an end cap 34 at an upper end thereof, a transversely extending partition 36, and a base 38 at a lower end thereof. The shell 32, the base 38 and the partition 36 may cooperate to define a suction-pressure chamber 39. The end cap 34 and the partition 36 may define a discharge chamber 40. The partition 36 may separate the discharge chamber 40 from the suction-pressure chamber 39. A discharge-pressure passage 43 may extend through the partition 36 to provide communication between the compression mechanism 20 and the discharge chamber 40. The suction fitting 28 may be attached to the shell assembly 12 at an opening 46.

As shown in FIG. 1, the first bearing housing assembly 14 may be disposed within the suction-pressure chamber and may be fixed relative to the shell 32. The first bearing housing assembly 14 may include a first main bearing housing 48 and a first bearing 50. The first main bearing housing 48 may house the first bearing 50 therein. The first main bearing housing 48 may fixedly engage the shell 32 and may axially support the compression mechanism 20.

As shown in FIG. 1, the motor assembly 18 may be disposed within the suction-pressure chamber 39 and may include a stator 60 and a rotor 62. The stator 60 may be press fit into the shell 32. The rotor 62 may be press fit on a drive shaft 64 and may transmit rotational power to the drive shaft 64. The drive shaft 64 may be rotatably supported by the first and second bearing housing assemblies 14, 16. The drive shaft 64 may include an eccentric crank pin 66 having a crank pin flat.

As shown in FIG. 1, the compression mechanism 20 may be disposed within the suction-pressure chamber 39 and may include an orbiting scroll 70 and a non-orbiting scroll 72. The first scroll member or orbiting scroll 70 may include an end plate 74 and a spiral wrap 76 extending therefrom. A cylindrical hub 80 may project downwardly from the end plate 74. A drive bushing may be disposed in the hub 80 and may receive the crank pin 66. An Oldham coupling 84 may be engaged with the orbiting and non-orbiting scrolls 70, 72 to prevent relative rotation therebetween.

As shown in FIG. 1, the second scroll member or non-orbiting scroll 72 may include an end plate 86 and a spiral wrap 88 projecting downwardly from the end plate 86. The spiral wrap 88 may meshingly engage the spiral wrap 76 of the orbiting scroll 70, thereby creating a series of moving fluid pockets. The fluid pockets defined by the spiral wraps 76, 88 may decrease in volume as they move from a radially outer position (at a suction pressure) to a radially intermediate position (at an intermediate pressure) to a radially inner position (at a discharge pressure) throughout a compression cycle of the compression mechanism 20. As shown in FIGS. 1-3, a suction inlet 89 may be formed in the non-orbiting scroll 72 and may provide fluid communication between the suction conduit 30 and a radially outermost fluid pocket 93 (FIG. 1) formed by the spiral wraps 76, 88.

The non-orbiting scroll 72 may include an upper scroll piece 94 that is mounted to the end plate 86 (lower scroll piece). The upper scroll piece 94 is mounted to an upper surface 96 of the end plate 86. Fasteners (e.g., threaded fasteners) may extend through mounting apertures 98 (FIG. 3) of the upper scroll piece 94 and into mounting apertures 100 (FIG. 3) in the end plate 86. The upper scroll piece 94 may include an upper annular recess 102 that may receive a floating seal assembly 104, as shown in FIG. 1. The upper annular recess 102 may be defined by (and disposed radially between) a central hub 116 of the upper scroll piece 94 and an outer annular rim 157 of the upper scroll piece 94.

The upper scroll piece 94 may also include a lower recess 106 (FIG. 2) in which variable-compression-ratio valves 108 may be disposed. Each of the variable-compression-ratio valves 108 may include a valve member (e.g., a reed valve) 110 and a valve backer 112. The valve member 110 is movable relative to the end plate 86 to selectively open and close variable-compression-ratio ports 114 formed in the end plate 86. The variable-compression-ratio ports 114 are in fluid communication with intermediate-pressure pockets formed by the spiral wraps 76, 88. The variable-compression-ratio valves 108 selectively allow and prevent fluid communication between the intermediate-pressure pockets and the discharge chamber 40. The variable-compression-ratio valves 108 may be mounted to the end plate 86 by fasteners (e.g., pins or threaded fasteners) that engage apertures 109 (FIG. 3) in the end plate 86. A seal (e.g., O-ring) 107 may encircle the lower recess 106 and may sealingly engage the end plate 86 and upper scroll piece 94.

As shown in FIG. 2, the central hub 116 of the upper scroll piece 94 may define a valve guide (or valve housing) 118 and one or more apertures 120. The apertures 120 may be in fluid communication with the lower recess 106 and the discharge chamber 40. The valve guide 118 may movably engage (and guide movement of) a portion of a primary discharge valve member (or shutdown device) 122. For example, the valve guide 118 may include an aperture that reciprocatingly receives a stem 124 of the valve member 122. A head 126 of the valve member 122 may selectively open and close a discharge passage 128 formed in the end plate 86 to selectively allow and prevent fluid communication between the discharge passage 128 and the discharge chamber 40. The discharge passage 128 receives fluid from a discharge-pressure pocket formed by the spiral wraps 76, 88.

The suction conduit 30 may direct working fluid at a suction-pressure from the suction fitting 28 to the suction inlet 89 of the non-orbiting scroll 72 so that working fluid can be directed into the radially outermost fluid pocket 93 and subsequently compressed by the compression mechanism 20. As shown in FIGS. 1 and 2, a portion of the suction conduit 30 may snap into engagement with a wall 90 of the non-orbiting scroll 72 (e.g., a wall that defines a lower end of the suction inlet 89) and another portion of the suction conduit 30 may be captured or clamped between the upper scroll piece 94 and the end plate 86.

Figure 4:
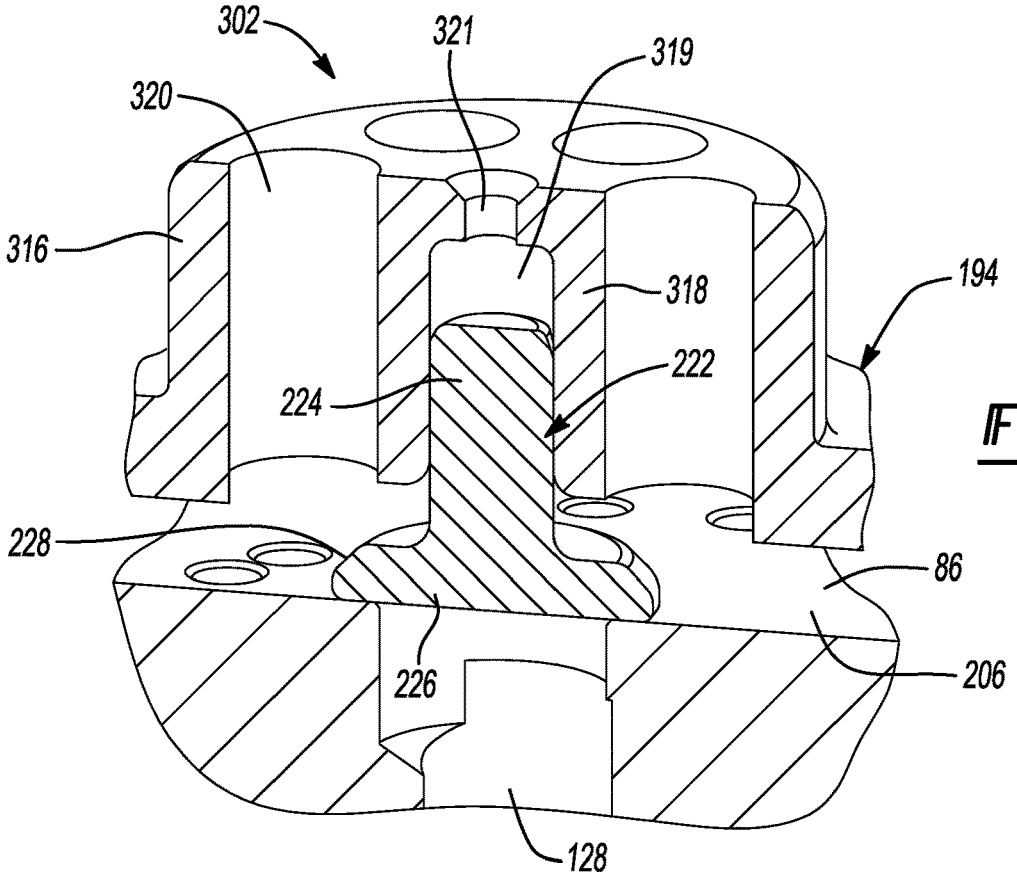
FIG. 4 is a partial cross-sectional view of a discharge valve member and upper and lower scroll pieces of a non-orbiting scroll with the discharge valve member in a closed position.
Figure 5:
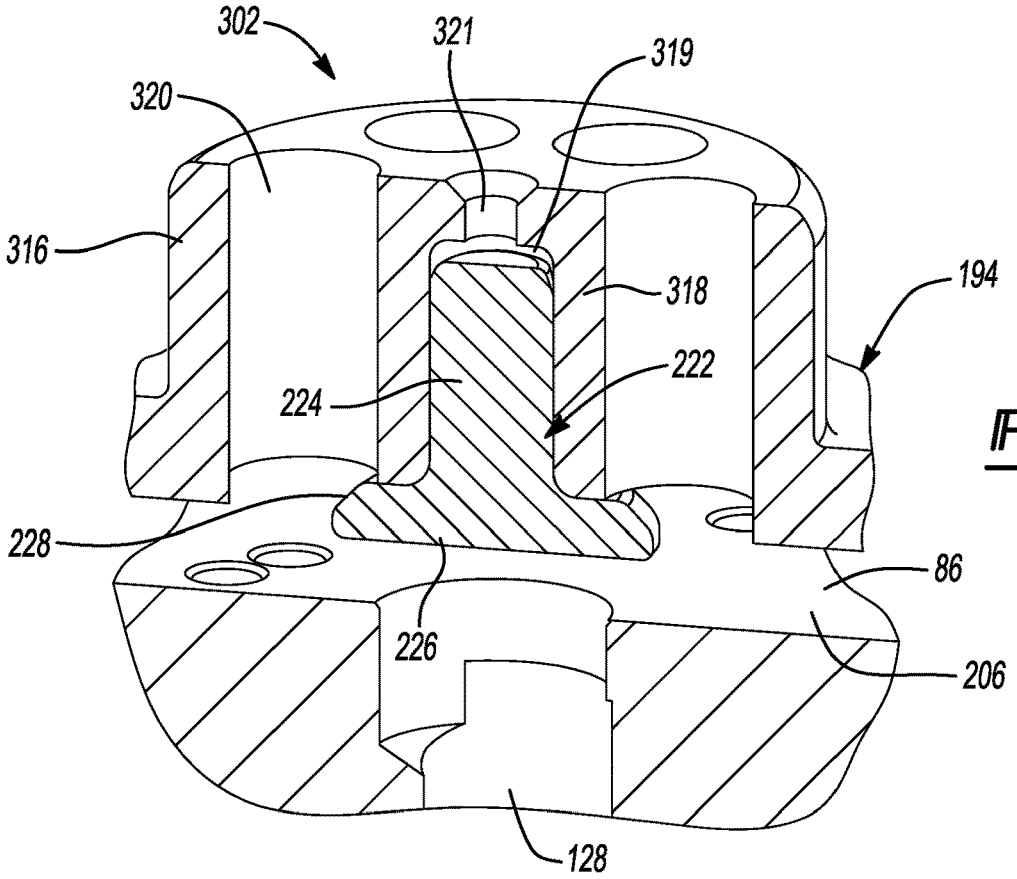
FIG. 5 is a partial cross-sectional view of the discharge valve member and upper and lower scroll pieces of FIG. 4 with the discharge valve member in an open position.

Referring now to FIGS. 4 and 5, another upper scroll piece 194 (only partially shown) and another primary discharge valve member 222 are provided. The upper scroll piece 194 and valve member 222 may be incorporated into the compressor 10 instead of the upper scroll piece 94 and valve member 122.

The upper scroll piece 194 may be similar or identical to the upper scroll piece 94 described above, apart from differences described below. Like the upper scroll piece 94, the upper scroll piece 194 may include an outer annular rim (similar or identical to outer annular rim 157) and a central hub 316 (similar to the central hub 116) that cooperate to define an upper annular recess 202 (similar or identical to upper annular recess 102). As shown in FIGS. 4 and 5, the central hub 316 of the upper scroll piece 194 may be structured differently than the central hub 116.

The central hub 316 may define a valve housing for the valve member 222. In this manner, the central hub 316 and the valve member 22 cooperate to define a shutdown assembly (or discharge valve assembly) 302. The central hub 316 may include a plurality of apertures 320 that extend therethrough. The apertures 320 provide fluid communication between a lower recess 206 (similar or identical to lower recess 106) of the upper scroll piece 194 and the discharge chamber 40. The central hub 316 may also include a valve guide 318 defining a guide recess 319. The apertures 320 may be arranged in a circular pattern that encircles the guide recess 319. Central aperture 321 may extend through a central portion of the central hub 316 and may be in fluid communication with the discharge chamber 40 and the guide recess 319. A diameter of the central aperture 321 may be smaller than a diameter of the guide recess 319, The valve member 222 may include a stem 224 and a head 226. The stem 224 may have a smaller diameter than the head 226. The head 226 may be disposed at an axial end of the stem 224. The stem 224 may be reciprocatingly received in the guide recess 319 such that the valve member 222 is movable relative to the upper scroll piece 194 and the end plate 86 between a closed position (FIG. 4) and an open position (FIG. 5).

In the closed position, the head 226 of the valve member 222 may contact the end plate 86 to prevent fluid flow through the discharge passage 128 (i.e., to prevent fluid communication between the discharge passage 128 and the discharge chamber 40). In the open position, the head 226 of the valve member 222 is spaced apart from the end plate 86 to allow fluid flow through the discharge passage 128 and through the apertures 320 (i.e., to allow fluid communication between the discharge passage 128 and the discharge chamber 40 via the apertures 320). When the compressor 10 shuts down, the valve member 222 is forced to move from the open position to the closed position. At shutdown of the compressor 10, working fluid in the discharge chamber 40 may flow into the central aperture 321 and into the guide recess 319 to aid in forcing the valve member 222 toward the closed position.

As noted above, a diameter of the head 226 of the valve member 222 may be larger than a diameter of the stem 224 of the valve member 222. In some configurations, a ratio of the diameter of the head 226 to the diameter of the stem 224 may range from 2-10.

The relatively large diameter of the head 226 allows the valve member 222 to cover (prevent fluid flow through) the discharge passage 128 during shutdown. The relatively small diameter of the stem 224 allows for: (a) large, drilled discharge apertures 320 in the central hub 316 which reduce pressure drop through the shutdown assembly 302 and increase gas flow area and flow uniformity (which improves efficiency of the compressor 10), (b) reduced mass of the valve member 222 (compared to single diameter shutdown devices) to reduce dynamic operation occurrence (which improves reliability of the shutdown assembly 302 and compressor 10), and (c) reduced oil stiction of the valve member 222 to the valve guide 318 because of the small contact area along the guiding length (which improves shutdown response).

As shown in FIGS. 4 and 5, the head 226 of the valve member 222 may include a chamfer 228 that faces away from the end plate 86 (i.e., the chamber 228 is located on a top side of the head 226 opposite a bottom side of the head 226 that contacts the end plate 86 in the closed position). The chamfer 228 allows for improved gas flow around the head 226 when the valve member 222 is in the open position (i.e., during operation of the compressor 10), which improves efficiency of the compressor 10.

Figure 6:
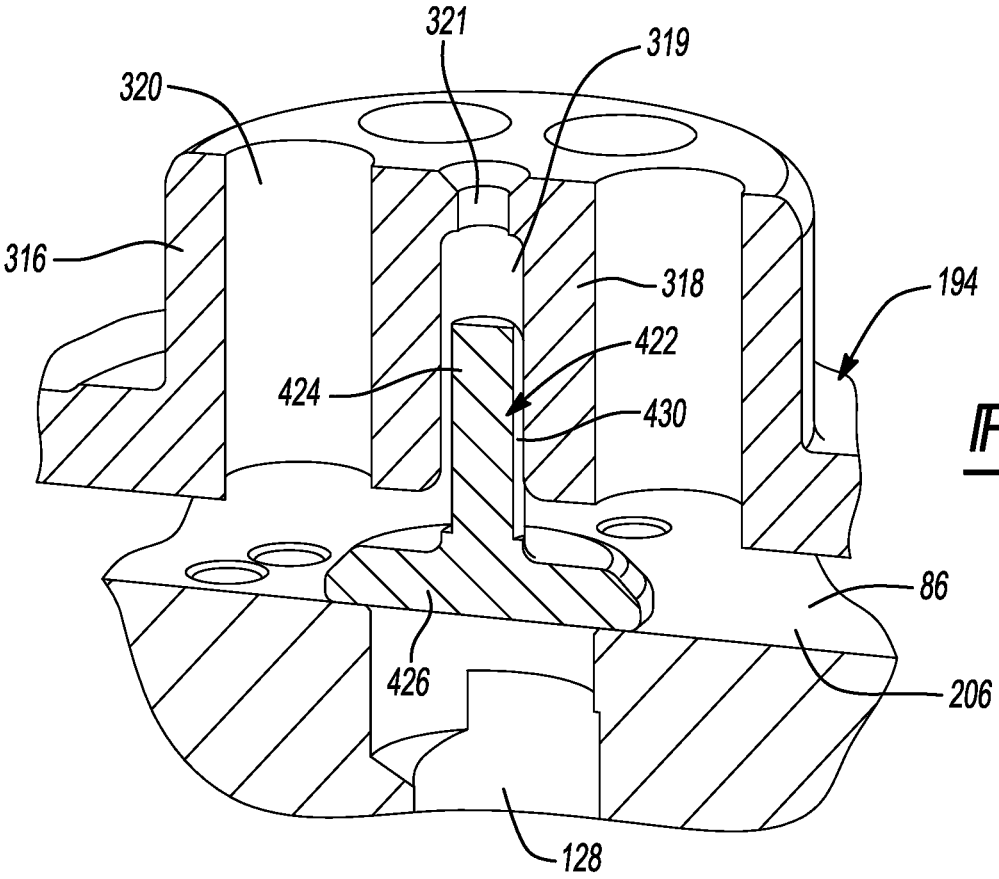
FIG. 6 is a partial cross-sectional view of another discharge valve member and the upper and lower scroll pieces of the non-orbiting scroll.
Figure 7:
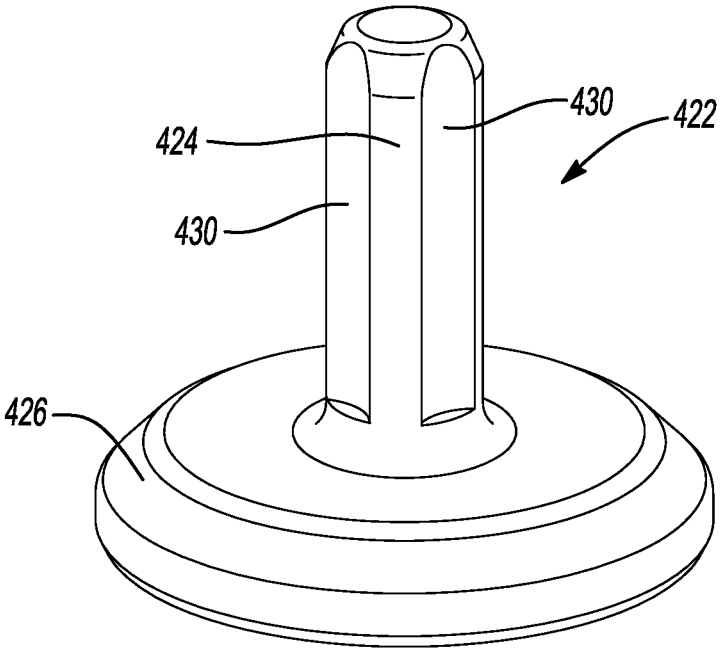
FIG. 7 is a perspective view of the discharge valve member of FIG. 6.

Referring now to FIGS. 6 and 7, another discharge valve member 422 is provided that may be incorporated into the compressor 10 (instead of the valve member 122, 322) with the upper scroll piece 194. The valve member 422 may include some or all of the features of the valve member 222 described above (e.g., including a stem 424 and head 426 having some or all of the features of the stem 224 and head 226). The stem 424 of the valve member 422 may also include a plurality of vertical grooves 430 (i.e., the grooves 430 extend in an axial direction parallel to a longitudinal axis of the stem 424). The grooves 430 reduce the contact area between the stem 424 and the valve guide 318, which reduces oil stiction of the valve member 422 to the valve guide 318 while still retaining sufficient alignment of the valve member 422 relative to the central hub 316 and end plate 86.

Figure 8:
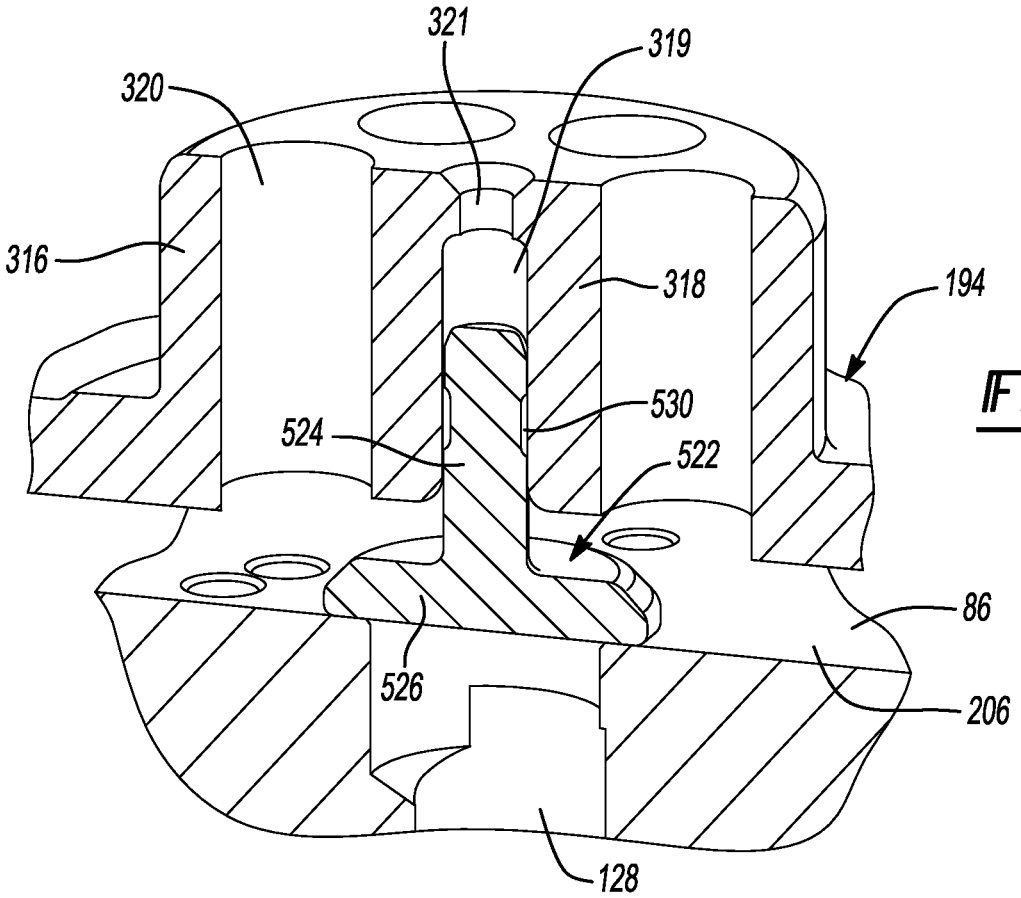
FIG. 8 is a partial cross-sectional view of yet another discharge valve member and the upper and lower scroll pieces of the non-orbiting scroll.
Figure 9:
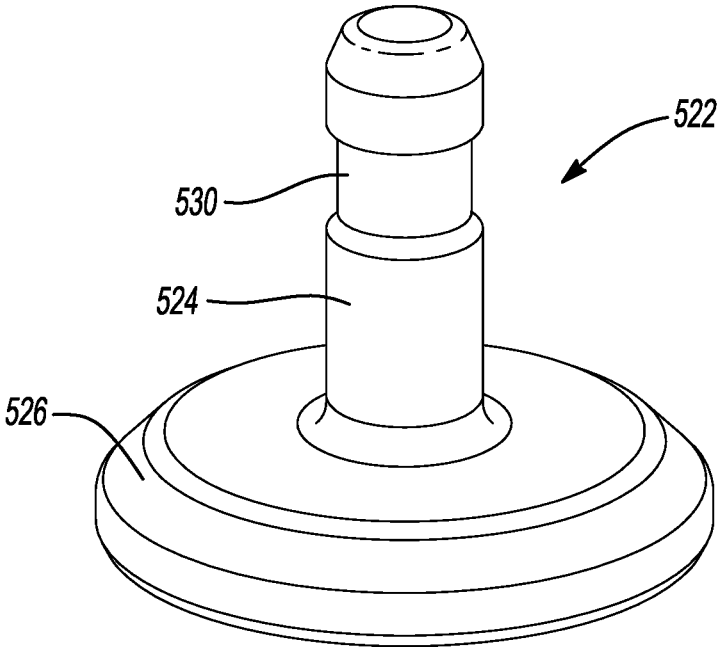
FIG. 9 is a perspective view of the discharge valve member of FIG. 8.

Referring now to FIGS. 8 and 9, another discharge valve member 522 is provided that may be incorporated into the compressor 10 (instead of the valve member 122, 322, 422) with the upper scroll piece 194. The valve member 522 may include some or all of the features of the valve member 222 described above (e.g., including a stem 524 and head 526 having some or all of the features of the stem 224 and head 226). The stem 524 of the valve member 522 may also include one or more horizontal grooves 530 (i.e., the groove is an annular groove and extends in a circumferential direction and encircles the longitudinal axis of the stem 524). The grooves 530 reduces the contact area between the stem 524 and the valve guide 318, which reduces oil stiction of the valve member 522 to the valve guide 318 while still retaining sufficient alignment of the valve member 522 relative to the central hub 316 and end plate 86.

Figure 10:
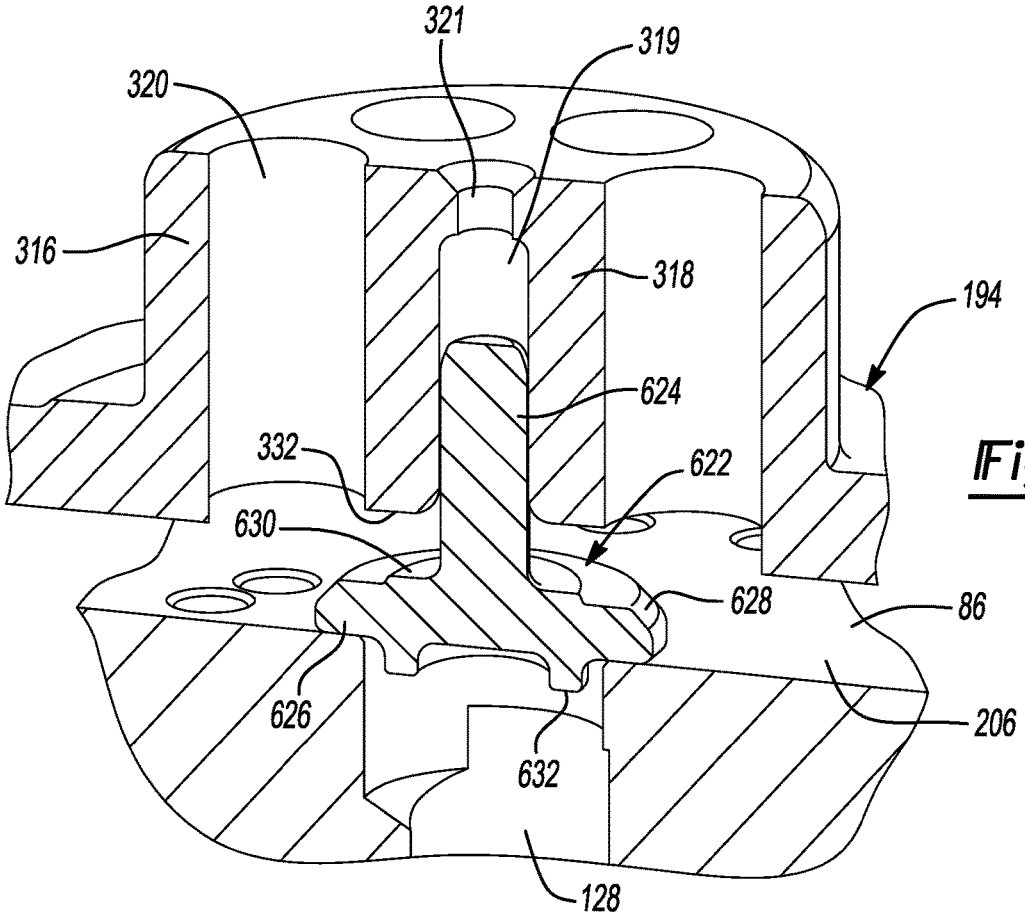
FIG. 10 is a partial cross-sectional view of yet another discharge valve member and the upper and lower scroll pieces of the non-orbiting scroll.

Referring now to FIG. 10, another discharge valve member 622 is provided that may be incorporated into the compressor 10 (instead of the valve member 122, 322, 422, 522) with the upper scroll piece 194. The valve member 622 may include some or all of the features of the valve member 222, 422, 522 described above (e.g., including a stem 624 and head 626 having some or all of the features of the stem 224, 424, 524 and head 226, 426, 526). The head 626 of the valve member 622 may also include a raised boss (or stepped-up portion) 630 formed on a top side of the head 626 (opposite a bottom side of the head 626 that contacts the end plate 86 in the closed position). The raised boss 630 has a smaller diameter than the outer diameter of the head 626 and the innermost diameter of chamfer 628 of the head 626. The raised boss 630 may allow for reduced contact area with an axial end surface 332 of the valve guide 318, which reduces oil stiction between the valve member 622 and the valve guide 318.

The head 626 of the valve member 622 may also include a protrusion 632 (e.g., an annular protrusion or disc-shaped protrusion) formed on the bottom side of the head 626 (e.g., on the side of the head 626 opposite the top side that includes the raised boss 630). The protrusion 632 may extend from the head 626 into the discharge passage 128. The protrusion 632 may aid in assembly of the shutdown assembly. For example, the protrusion 632 may act as a guide to position the valve member 622 on the end plate 86 prior to the upper scroll piece 194 being positioned on the end plate 86 and bolted thereto.

Figure 11:
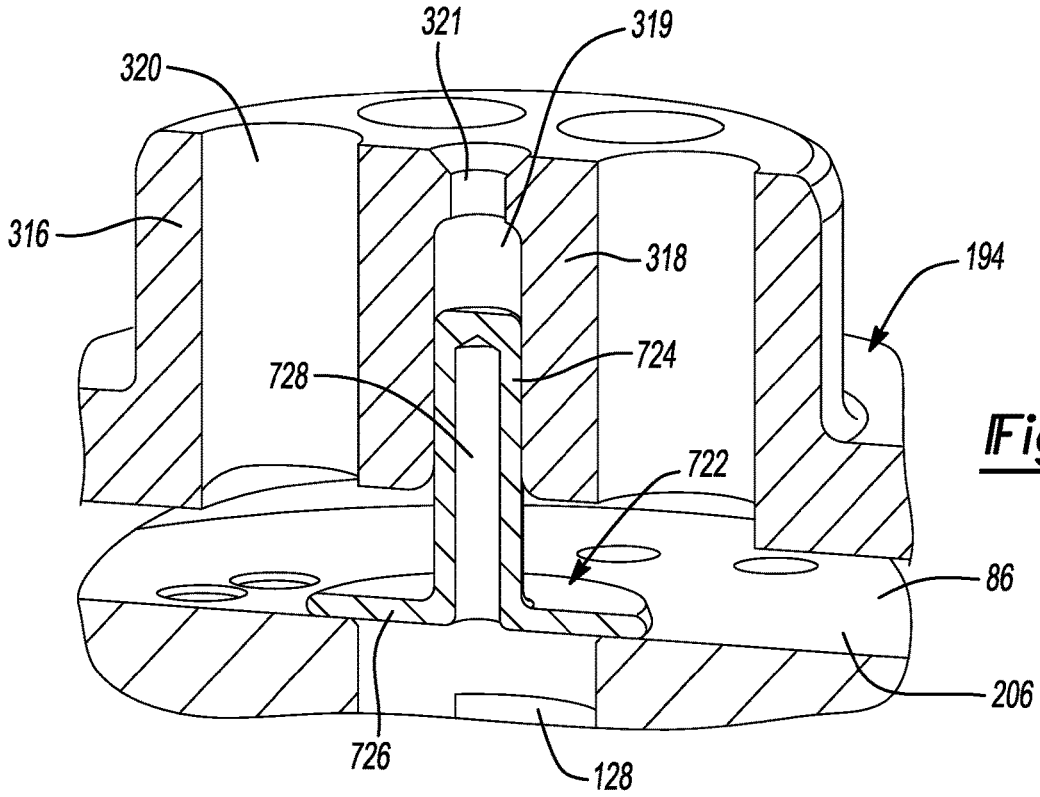
FIG. 11 is a partial cross-sectional view of yet another discharge valve member and the upper and lower scroll pieces of the non-orbiting scroll.

Referring now to FIG. 11, another discharge valve member 722 is provided that may be incorporated into the compressor 10 (instead of the valve member 122, 322, 422, 522, 622) with the upper scroll piece 194. The valve member 722 may include some or all of the features of the valve member 222, 422, 522, 622 described above (e.g., including a stem 724 and head 726 having some or all of the features of the stem 224, 424, 524, 624 and head 226, 426, 526, 626). The valve member 722 may also include an aperture 728 that may extend through some or all of the length of the stem 724 and/or may extend through some or all of the length of the head 726. The aperture 728 reduces the mass of the valve member 722, which may improve the efficiency of the compressor 10. Furthermore, the reduced thickness of the head 726 also reduces the overall mass of the valve member 722, which may improve the efficiency of the compressor 10.

Figure 12:
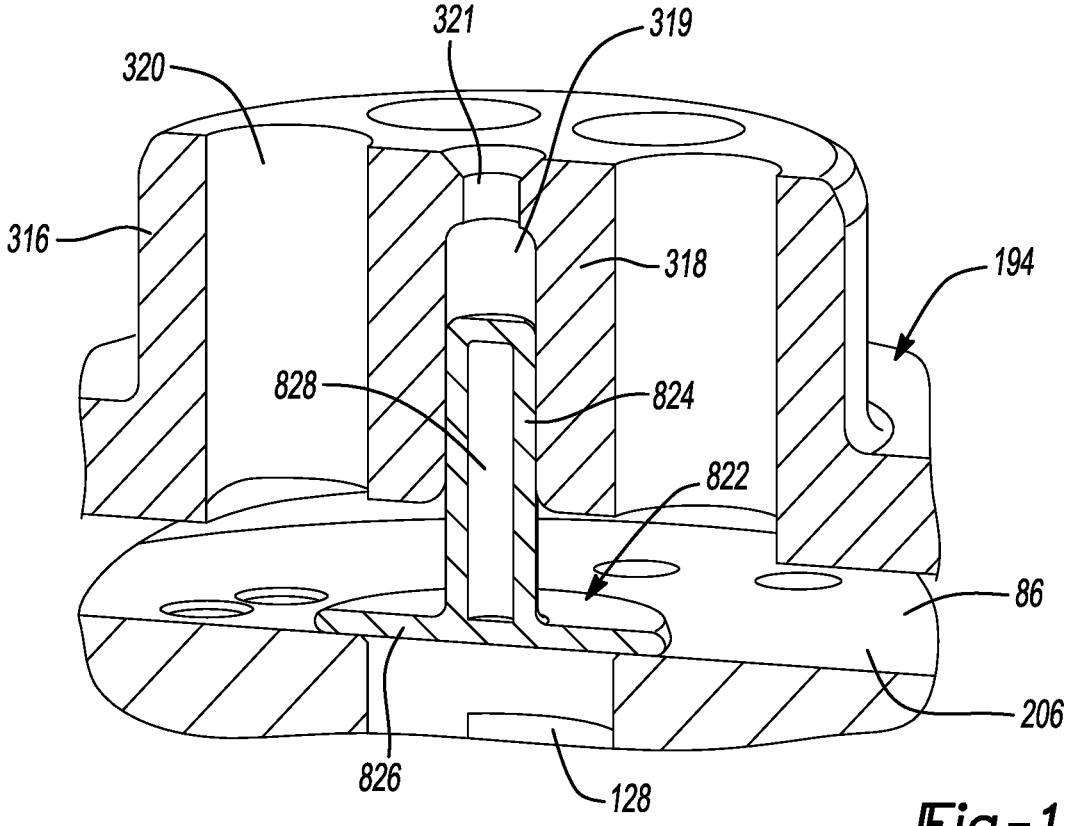
FIG. 12 is a partial cross-sectional view of yet another discharge valve member and the upper and lower scroll pieces of the non-orbiting scroll.

Referring now to FIG. 12, another discharge valve member 822 is provided that may be incorporated into the compressor 10 (instead of the valve member 122, 322, 422, 522, 622, 722) with the upper scroll piece 194. The valve member 822 may include some or all of the features of the valve member 222, 422, 522, 622, 722 described above (e.g., including a stem 824 and head 826 having some or all of the features of the stem 224, 424, 524, 624, 724 and head 226, 426, 526, 626, 726). The valve member 822 may also include an aperture 828 that may extend through some or all of the length of the stem 824 and/or may extend through some or all of the length of the head 826. The valve member 822 may be formed from multiple pieces that may be welded or otherwise attached to each other. For example, the head 826 and the stem 824 may be formed separately from each other and then welded or otherwise attached to each other.

Figure 13:
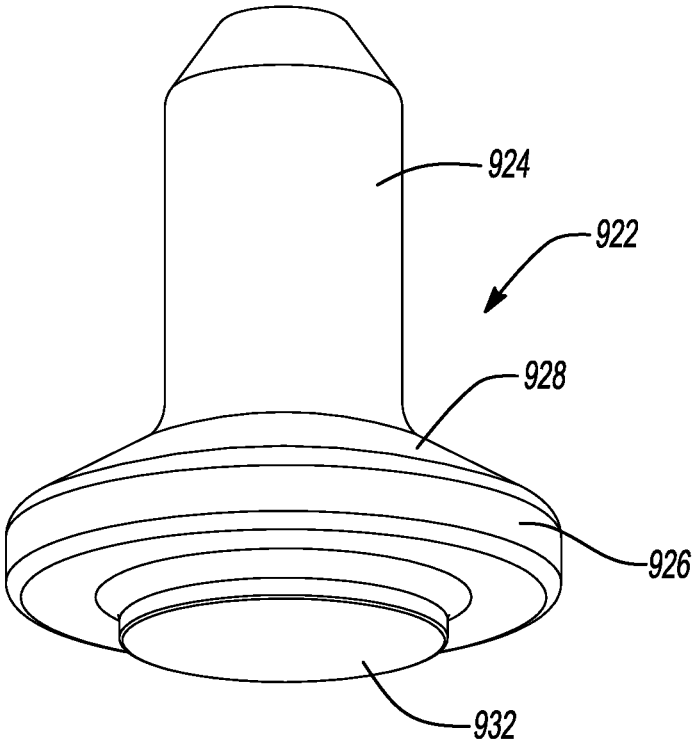
FIG. 13 is a perspective view of another discharge valve member.

Referring now to FIG. 13, another discharge valve member 922 is provided that may be incorporated into the compressor 10 (instead of the valve member 122, 322, 422, 522, 622, 722, 822) with the upper scroll piece 194. The valve member 922 may include some or all of the features of the valve member 222, 422, 522, 622, 722, 822 described above (e.g., including a stem 924 and head 926 having some or all of the features of the stem 224, 424, 524, 624, 724, 824 and head 226, 426, 526, 626, 726, 826). The head 926 of the valve member 922 may include a chamfer 928 that faces away from the end plate 86 (i.e., the chamber 928 is located on a top side of the head 926 opposite a bottom side of the head 926 that contacts the end plate 86 in the closed position). The large chamfer 928 shown in FIG. 13 contacts the axial end surface 332 of the valve guide 318, which results in reduced contact area with the axial end surface 332, which reduces oil stiction.

The head 926 of the valve member 922 may also include a protrusion 932 (e.g., an annular protrusion or disc-shaped protrusion) formed on the bottom side of the head 926 (e.g., on the side of the head 926 opposite the top side that includes the chamfer 928). Like the protrusion 632 described above, the protrusion 932 may extend from the head 926 into the discharge passage 128 and may facilitate assembly.

Shutdown assemblies described above and/or shown in any of the figures have improved performance over the prior-art shutdown valves in several parameters including, for example, improved shutdown response time, reduced backflow leakage, reduced pressure loss across the shutdown assembly, reduced power loss, good stress and fatigue levels, good dynamic response, good impact velocity/force. Additionally, the shutdown assemblies according to the principles of the present disclosure provide the following advantages: reduced power loss compared to the prior-art shutdown valve by allowing more gas flow and/or more efficient gas flow; reduced noise by providing quicker and quieter compressor shutdowns by limiting backwards gas flow into the scroll set; reduced dynamic response; lower cost to manufacture & uses less parts than the prior-art shutdown valve; and easier to assemble and does not require adhesive.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

an orbiting scroll;

a non-orbiting scroll meshingly engaged with the orbiting scroll and including a lower scroll piece and an upper scroll piece that is fixedly mounted to the lower scroll piece, wherein the upper scroll piece includes a central hub that defines a valve housing having a valve guide and a plurality of first apertures disposed around the valve guide;

a discharge valve member having a valve stem and a valve head disposed at an axial end of the valve stem, wherein the valve head is disposed in a recess, wherein the recess is formed in a first surface of the upper scroll piece that faces the lower scroll piece, wherein a second surface of the lower scroll piece partially encloses the recess, and wherein the second surface of the lower scroll piece opposes the first surface of the upper scroll piece; and variable-compression-ratio valves disposed within the recess and spaced apart from the discharge valve member, wherein the variable-compression-ratio valves selectively open and close respective variable-compression-ratio ports disposed in the lower scroll piece, wherein the valve stem is movably received in a second aperture formed in the valve guide and has a smaller diameter than a diameter of the valve head, wherein the valve member is movable relative to the upper and lower scroll pieces between a closed position in which the valve head blocks a discharge passage in the lower scroll piece to restrict fluid flow therethrough and an open position in which the valve head allows fluid flow through the discharge passage.

2. The compressor of claim 1, wherein the valve head includes a first side that contacts the second surface of the lower scroll piece when the valve member is in the closed position, wherein the valve head includes a second side opposite the first side, and wherein a chamfer is formed on the second side at an outer periphery of the valve head.

3. The compressor of claim 2, wherein a raised boss is formed on the second side of the valve head, and wherein the raised boss is disposed radially between the valve stem and the chamfer.

4. The compressor of claim 3, wherein the first side of the valve head includes a protrusion that extends into the discharge passage when the valve member is in the closed position.

5. The compressor of claim 1, wherein the valve member includes a groove formed in an outer diametrical surface of the valve stem.

6. The compressor of claim 5, wherein the groove is an annular groove that encircles a longitudinal axis of the valve stem.

7. The compressor of claim 5, wherein the groove is an axially extending groove and extends in a direction parallel to a longitudinal axis of the valve stem.

8. The compressor of claim 7, wherein the valve member includes at least another axially extending groove formed in the outer diametrical surface of the valve stem and extending in the direction parallel to the longitudinal axis of the valve stem.

9. The compressor of claim 1, wherein a third aperture extends through at least a portion of the valve stem.

10. The compressor of claim 9, wherein the third aperture extends through the valve head.

11. The compressor of claim 1, wherein the variable-compression-ratio valves are mounted to the second surface of the lower scroll piece.

* * * * *